US008294531B2

(12) United States Patent
Sakiyama et al.

(10) Patent No.: US 8,294,531 B2
(45) Date of Patent: Oct. 23, 2012

(54) MICROSTRIP LINE PROVIDED WITH CONDUCTOR SECTION HAVING GROOVE FORMED TO STERICALLY INTERSECT STRIP CONDUCTOR

(75) Inventors: Kazuyuki Sakiyama, Osaka (JP); Akira Minegishi, Osaka (JP)

(73) Assignee: Panasonic Corporation, Osaka (JP)

( * ) Notice: Subject to any disclaimer, the term of this patent is extended or adjusted under 35 U.S.C. 154(b) by 273 days.

(21) Appl. No.: 12/664,431

(22) PCT Filed: Feb. 24, 2009

(86) PCT No.: PCT/JP2009/000795

§ 371 (c)(1),
(2), (4) Date: Dec. 14, 2009

(87) PCT Pub. No.: WO2009/128193

PCT Pub. Date: Oct. 22, 2009

(65) Prior Publication Data

US 2010/0171574 A1 Jul. 8, 2010

(30) Foreign Application Priority Data

Apr. 14, 2008 (JP) ..... 2008-104557

(51) Int. Cl.
*H01P 3/08* (2006.01)

(52) U.S. Cl. ..... 333/33; 333/246

(58) Field of Classification Search ..... 333/238, 333/246, 33

See application file for complete search history.

(56) References Cited

U.S. PATENT DOCUMENTS

| | | | | |
|---|---|---|---|---|
| 5,519,363 | A | 5/1996 | Boudreau et al. | |
| 5,648,748 | A * | 7/1997 | Isida | 333/246 |
| 6,545,572 | B1 * | 4/2003 | Ohta et al. | 333/246 |
| 2002/0158722 | A1 * | 10/2002 | Maruhashi et al. | 333/246 |
| 2004/0000959 | A1 * | 1/2004 | Howard et al. | 333/4 |

FOREIGN PATENT DOCUMENTS

| | | |
|---|---|---|
| JP | 3-158002 | 7/1991 |
| JP | 5-251914 | 9/1993 |
| JP | 7-135407 | 5/1995 |
| JP | 7-336114 | 12/1995 |
| JP | 2001-53507 | 2/2001 |

OTHER PUBLICATIONS

International Search Report issued Apr. 28, 2009 in International (PCT) Application No. PCT/JP2009/000795.

Caloz, C. et al., Application of the transmission line theory of left-handed (LH) materials to the realization of a microstrip "LH line", *IEEE-APS International Symposium Digest*, vol. 2 (Jun. 2002), pp. 412-415.

English translation of the International Preliminary Report on Patentability and the Written Opinion of the International Searching Authority issued Dec. 9, 2010 in International (PCT) Application No. PCT/JP2009/000795.

* cited by examiner

*Primary Examiner* — Benny Lee

(74) *Attorney, Agent, or Firm* — Wenderoth, Lind & Ponack, L.L.P.

(57) ABSTRACT

A microstrip line is constituted by including a grounding conductor and a strip conductor with a dielectric substrate being sandwiched between the grounding conductor and the strip conductor. The microstrip line includes a conductor section having at least one groove formed to sterically intersect the strip conductor, thereby exhibiting a substantially more uniform passing characteristic as compared with a prior art microstrip line.

7 Claims, 31 Drawing Sheets

MICROSTRIP LINE PROVIDED WITH CONDUCTOR SECTION HAVING GROOVE FORMED TO STERICALLY INTERSECT STRIP CONDUCTOR

TECHNICAL FIELD

The present invention relates to a microstrip line for transmitting a digital signal, realizing a substantially more uniform passing frequency characteristic in a wideband, and including a signal waveform impedance-matching device for making impedance-matching of a waveform of the digital signal.

BACKGROUND ART

FIG. 29A is a plan view showing a configuration of an ordinary microstrip line according to a first prior art. FIG. 29B is a longitudinal sectional view taken along a D-D' line shown in FIG. 29A. FIG. 30 is a perspective view of the microstrip line shown in FIGS. 29A and 29B.

As a method of transmitting a digital signal on a printed circuit board, a method using a microstrip line is normally adopted, in which uses the microstrip line is configured to include a strip conductor 12 and a grounding conductor 11 (FIGS. 29B and 30) with a dielectric substrate 10 sandwiched between the strip conductor 12 and the grounding conductor 11 as shown in FIGS. 29A, 29B and 30. As a transmission line of the microstrip line, various microstrip line-type transmission lines have been known such as a single-ended transmission line, a differential transmission line and a coplanar transmission line. The microstrip line is characterized as follows. If material characteristics of the transmission line and a substrate are uniform, a characteristic impedance is decided by shapes of the transmission line, and the substrate and a signal transmission characteristic having the uniform characteristic impedance can be obtained.

However, if a wiring layout is designed on a printed circuit board using the above-stated microstrip line, it is frequently required to change a line width halfway along the line or to design the microstrip line. In this way, because the shape of the line is discontinuous, the characteristic impedance of the transmission line changes. Furthermore, an amount of this change in the characteristic impedance depends on a frequency. As a result, the change in the characteristic impedance disadvantageously causes deterioration in a waveform of a transmission signal.

As measures against the above-stated waveform deterioration, there has been known a design method for suppressing signal deterioration by minimizing the change in the characteristic impedance as much as possible (See, for example, Patent Document 1).

FIG. 31A is a cross-sectional view of a wiring board that uses a microstrip line according to a second prior art. FIG. 31B is a longitudinal sectional view taken along a line A-A' shown in FIG. 31A. FIG. 31C is a longitudinal sectional view taken along a line B-B' shown in FIG. 31A. FIG. 31D is a longitudinal sectional view taken along a line C-C' shown in FIG. 31A. The microstrip line according to the second prior art is intended to reduce discontinuity of the characteristic impedance according to the prior art described in the Patent Document 1. A method of designing a microstrip line according to the second prior art will be described below with reference to FIGS. 31A to 31D. It is noted that a core material 140 of the wiring board that used the microstrip according to the second prior art is shown.

Referring to FIGS. 31A to 31D, the microstrip is configured to include grounding conductor 110, strip conductor 120 (FIGS. 31B to 31D), a convex portion 121 (FIG. 31D) of the strip conductor 120, and a dielectric material 130 (FIGS. 31B to 31D). Additionally, the microstrip according to the second prior art is configured so that a width of the strip conductor 120 and a distance between the grounding conductor 110 and the strip conductor 120 changes between cross-sections B-B' and C-C'. Therefore, by changing a capacitance between the grounding conductor 110 and the strip conductor 120, it is advantageously possible to suppress an amount of a change in a characteristic impedance of the transmission line.

FIGS. 32A to 32D and 33 show an example of a configuration of a microstrip line according to a third prior art which has discontinuity and in which a grounding conductor is eliminated halfway. FIG. 32A is a front view of the microstrip line according to the third prior art. FIG. 32B is a plan view of the microstrip line shown in FIG. 32A. FIG. 32C is a longitudinal sectional view taken along a line E-E' shown in FIG. 32B. FIG. 32D is a side vide of the microstrip line shown in FIG. 32A. FIG. 33 is a perspective view of the microstrip line shown in FIGS. 32A to 32D.

In the case of the microstrip line shown in FIGS. 32A to 32D and 33, a capacitance between a strip conductor 12 and a grounding conductor 11 (FIGS. 32A, 32C, 32D, and 33), in which the strip conductor 12 and the grounding conductor 11 sandwich a dielectric substrate 10, is not present in a portion in which the grounding conductor 11 is not present. Therefore, with the method described in the Patent Document 1, an amount of a change in a characteristic impedance of the microstrip line cannot be reduced as desired and the method produces no advantageous effects.

Moreover, there has been known a design method using a high frequency metamaterial theory (See Non-Patent Document 1) as a design method for controlling characteristics of a transmission line.

FIG. 34 is a circuit diagram showing an equivalent circuit to a transmission line model that illustrates a high frequency material concept that is a design theory disclosed in the Non-Patent Document 1. Referring to FIG. 34, an outline of the high frequency metamaterial design theory will be described.

An equivalent circuit to an ordinary microstrip line can be represented as a ladder circuit configured to include inductors L1 and capacitors C1 shown in FIG. 34. The high frequency metamaterial design theory is the following circuit design method. A microstrip line is realized by adding inductors L1 and L2 and capacitors C1 and C2 to a transmission line having terminals T1, T2, T3, and T4, which leads to development of an electrical characteristic different from that of the transmission lines according to the prior arts and designing a desired characteristic impedance. The Non-Patent Document 1 shows an example of realizing a small-sized microstrip antenna compared to wavelengths in a high frequency electromagnetic field and a unique characteristic impedance corresponding to an effect of a negative index of refraction, and describes a method of controlling a characteristic impedance of a transmission line.

Patent Document 1: Japanese Patent Laid-Open Publication No. JP 2001-053507 A.

Non-Patent Document 1: C. Caloz et al., "Application of the transmission line theory of left-handed (LH) materials to the realization of a microstrip "LH line"", IEEE-APS International Symposium Digest, Vol. 2, pp. 412-415, June 2002.

SUMMARY OF THE INVENTION

Problems to be Solved by the Invention

However, in order to realize the model as shown in the Non-Patent Document 1 by an actual microstrip line, it is disadvantageously necessary to realize the capacitors C2 in series to the strip conductor 12 and means for realizing the strip conductor 12 in which effective capacitances are dispersed in series is unclear. Moreover, such a method as inserting capacitor elements each having a lumped constant may be considered as the means for realization. However, in this case, signal reflection and signal loss occur to portions in which the capacitor elements are connected due to the discontinuous impedance, which runs contrary to purpose of realization. Likewise, there has been known a method using microstrip-like stubs as a method of providing portions corresponding to the inductors L2 on the strip conductor 12. However, it is difficult to constitute microstrip-like stabs in gaps of wiring layout of the strip conductor 12.

As stated above, if the characteristic impedance of the microstrip line changes halfway along the line, deterioration, distortion and the like of the signal waveform occur to a portion in which the characteristic impedance changes.

It is an object of the present invention to provide a microstrip line that can solve the above-stated problems, and that can attain a substantially more uniform passing frequency characteristic in a wideband as compared with the prior arts even if a characteristic impedance of the microstrip line changes.

Means for Solving the Problems

According to the present invention, there is provided a microstrip line constituted by including a grounding conductor and a strip conductor with a dielectric substrate being sandwiched between the grounding conductor and the strip conductor. The microstrip line includes a conductor section having at least one groove formed to sterically intersect the strip conductor, and then, the microstrip line exhibiting a substantially more uniform passing characteristic as compared with the above-mentioned prior art microstrip line.

In the above-mentioned microstrip line, the groove is formed to be sterically orthogonal to the strip conductor.

In addition, in the above-mentioned microstrip line, the conductor section having the groove is formed as a separate component from the microstrip line.

Further, in the above-mentioned microstrip line, a dielectric section is formed on a the dielectric substrate-side of a component of the conductor section having the groove.

Still further, in the above-mentioned microstrip line, a component of the conductor section having the groove is inserted into and arranged in an opening of the grounding conductor.

Still further, in the above-mentioned microstrip line, a component of the conductor section having the groove is inserted into and arranged in an opening of the grounding conductor and an opening of the dielectric substrate.

In addition, in the above-mentioned microstrip line, the conductor section having the groove is provided on a surface side of the dielectric substrate on which side the grounding conductor is formed at a position at which the grounding conductor is formed.

Further, in the above-mentioned microstrip line, the conductor section having the groove is provided on a surface side of the dielectric substrate on which side the grounding conductor is formed at a position at which the grounding conductor is not formed.

In addition, in the above-mentioned microstrip line, the conductor section having the groove is provided on a surface side of the dielectric substrate on which side the strip conductor is formed at a position at which the grounding conductor is formed.

Further, in the above-mentioned microstrip line, a via conductor connecting the conductor section having the groove to the grounding conductor is formed in the conductor section.

Still further, in the above-mentioned microstrip line, the conductor section having the groove is provided on a surface side of the dielectric substrate on which side the strip conductor is formed at a position at which the grounding conductor is not formed.

Effects of the Invention

The microstrip line according to the present invention is constituted by including the grounding conductor and the strip conductor with the dielectric substrate sandwiched between the grounding conductor and the strip conductor and including a conductor section having at least one groove formed to sterically intersect the strip conductor. The microstrip line according to the present invention has thereby a substantially more uniform passing frequency characteristic than that of the above-stated microstrip line. As a consequence, the microstrip line to which deterioration of a signal waveform less occurs can be realized.

DESCRIPTION OF REFERENCE SYMBOLS

10 . . . Dielectric substrate,
10A . . . Opening of dielectric substrate,
11 . . . Grounding conductor,
11A . . . Insertion portion of conductor,
11B . . . Edge portion of conductor,
12 . . . Strip conductor,
14 . . . Conductor section having groove structure,
15 . . . Dielectric section,
16 . . . Via conductor,
21 . . . Groove, and
22 . . . Dielectric substance.

DETAILED DESCRIPTION OF THE INVENTION

Embodiments according to the present invention will be described hereinafter with reference to the drawings. It is to be noted that similar components are denoted by the same reference symbols, respectively, in the following embodiments and the prior arts.

First Embodiment

Figure 1A:
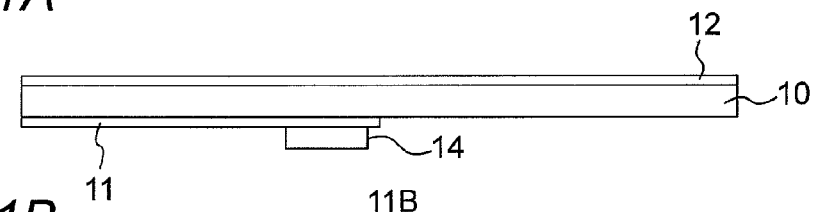
FIG. 1A is a front view showing a configuration of a microstrip line according to a first embodiment of the present invention.
Figure 1B:
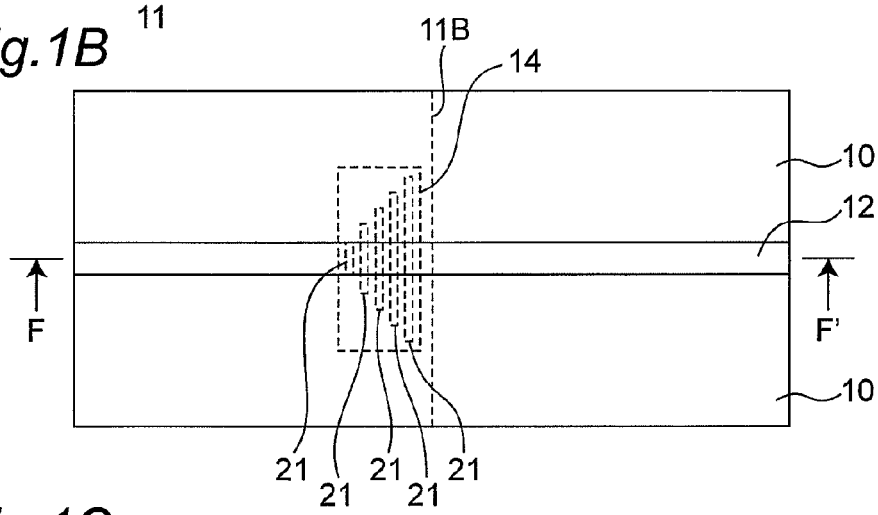
FIG. 1B is a plan view of the microstrip line shown in FIG. 1A.
Figure 1C:
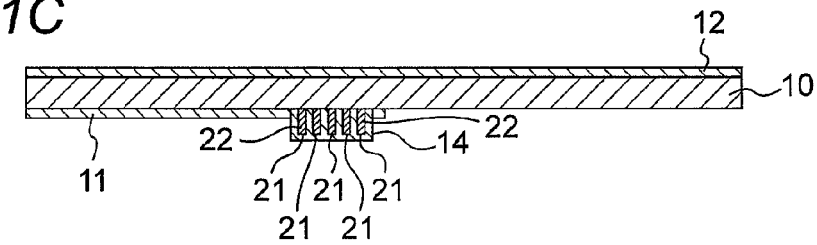
FIG. 1C is a longitudinal sectional view taken along a line F-F' shown in FIG. 1B.
Figure 1D:
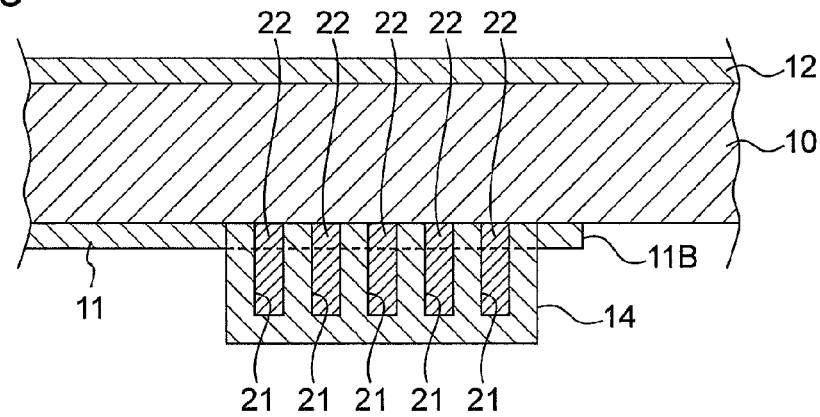
FIG. 1D is an enlarged view of principal parts shown in FIG. 1C.
Figure 2A:
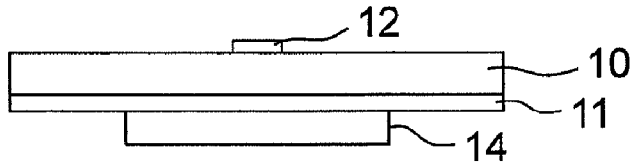
FIG. 2A is a side view of the microstrip line shown in FIGS. 1A to 1D.
Figure 2B:
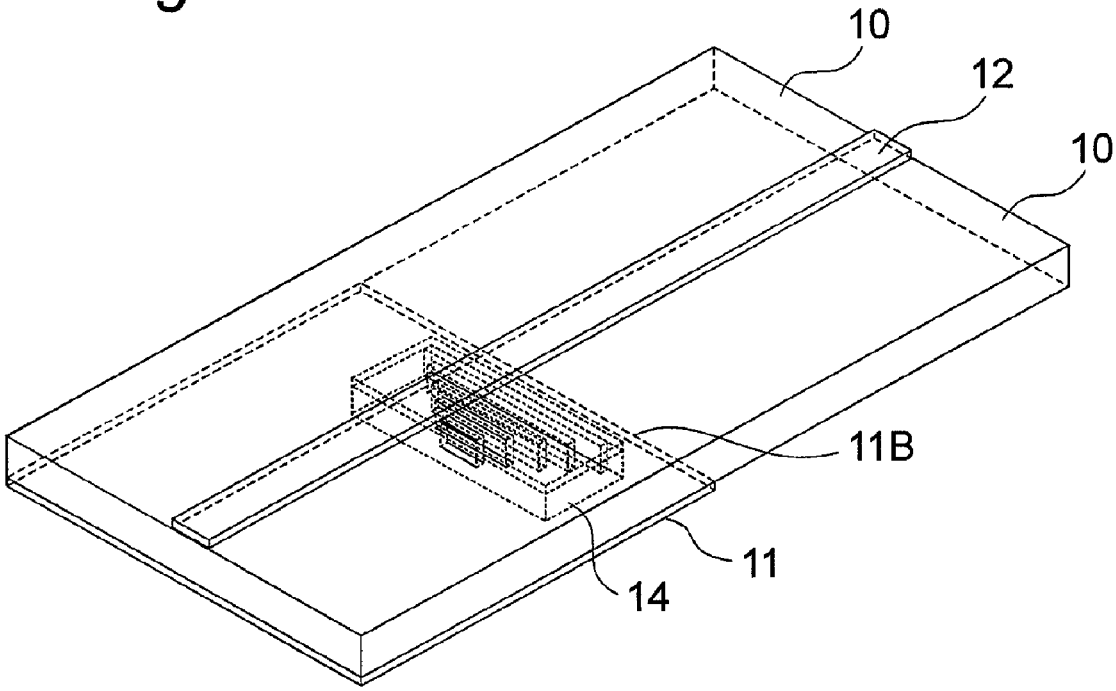
FIG. 2B is a perspective view of the microstrip line shown in FIGS. 1A to 1D.
Figure 2C:
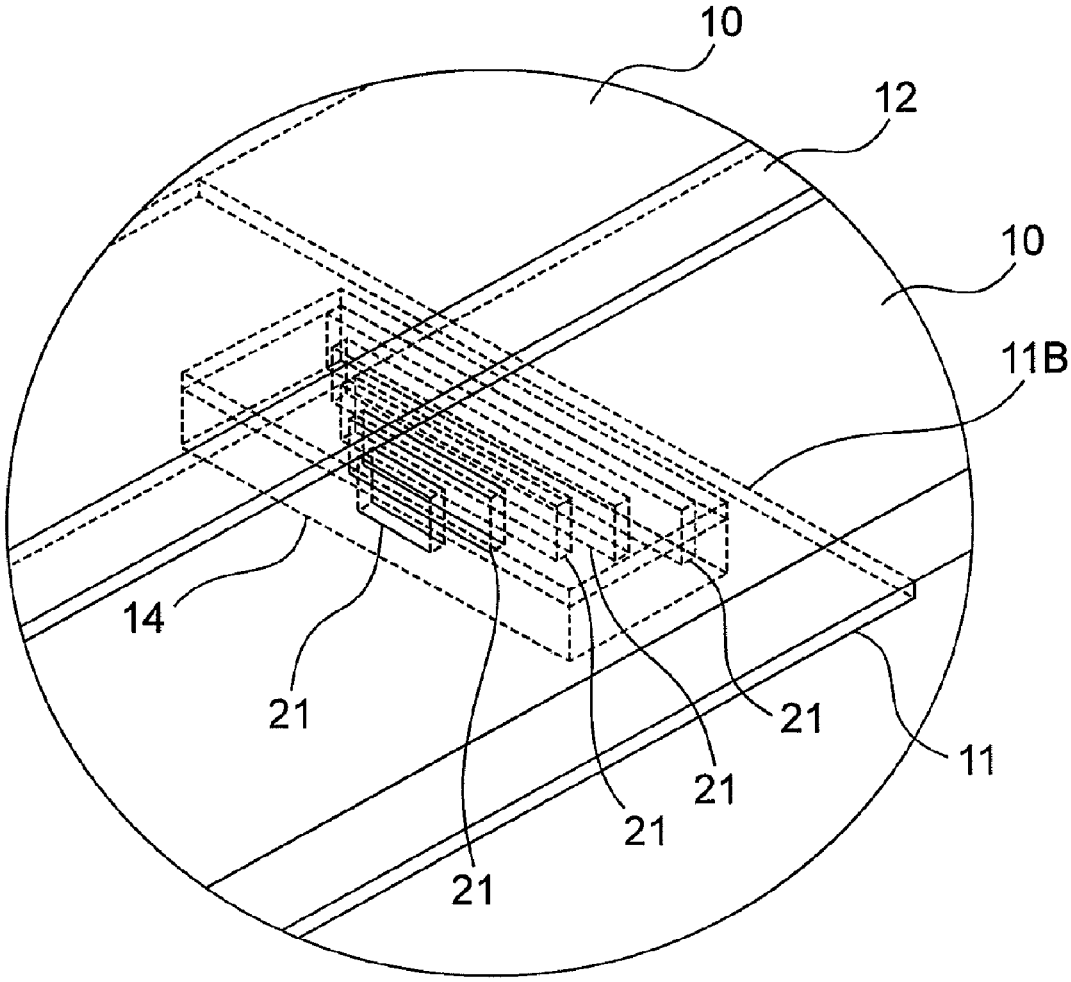
FIG. 2C is an enlarged view of principal parts shown in FIG. 2B.

FIG. 1A is a front view showing a configuration of a microstrip line according to a first embodiment of the present invention. FIG. 1B is a plan view of the microstrip line shown in FIG. 1A. FIG. 1C is a longitudinal sectional view taken along a line F-F' shown in FIG. 1B. FIG. 1D is an enlarged view of principal parts shown in FIG. 1C. FIG. 2A is a side view of the microstrip line shown in FIGS. 1A to 1D. FIG. 2B is a perspective view of the microstrip line shown in FIGS. 1A to 1D. FIG. 2C is an enlarged view of principal parts shown in FIG. 2B.

Referring to FIGS. 1A to 1D and 2A to 2C, a microstrip line according to the present embodiment is assumed to be configured so that in each of the microstrip lines according to the prior arts configured to include the grounding conductor 11 (FIGS. 1A, 1C, 1D, and 2A to 2C) and the strip conductor 12 with the dielectric substrate 10 sandwiched between the grounding conductor 11 and the strip conductor 12, in which the grounding conductor 11 is missing in an edge portion 11B (FIGS. 1B, 1D, 2B, and 2C) of the grounding conductor 11 (near a boundary between a portion in which the grounding conductor 11 is formed and a portion in which the grounding conductor 11 is not formed). The microstrip line according to the present embodiment is characterized in that a rectangular parallelepiped conductor section 14 having a groove structure constituted by including a plurality of rectangular parallelepiped grooves 21 (FIGS. 1B to 1D and 2C) in parallel to a direction substantially orthogonal to a longitudinal direction of the strip conductor 12 is formed integrally with the grounding conductor 11 in a portion near a discontinuous portion of the grounding conductor 11 in which portion the grounding conductor 11 is missing and right under the strip conductor 12. In this case, cavity spaces of the plural grooves 21 are in contact with the dielectric substrate 10 and these cavity spaces are formed by filling up dielectric substances 22 (FIGS. 1C and 1D), respectively. Furthermore, each groove 21 has a depth direction orthogonal to a surface of the dielectric substrate 10 (that is, each groove 21 does not penetrate in a depth direction of the conductor section 14) and has a length in a length direction orthogonal to the longitudinal direction of the strip conductor 12. Each groove 21 is formed so that the length in the length direction is larger in a direction from the edge portion 11B of the grounding conductor 11 toward the portion in which the grounding conductor 11 is formed and so as to be axisymmetric about a center line of the strip conductor 12.

While each groove 21 is formed to be orthogonal to the strip conductor 12, the present invention is not limited to this. Alternatively, each groove 21 may be formed to intersect the strip conductor 12 at least sterically (each groove 21 may three-dimensionally intersect the strip conductor 12).

Figure 3:
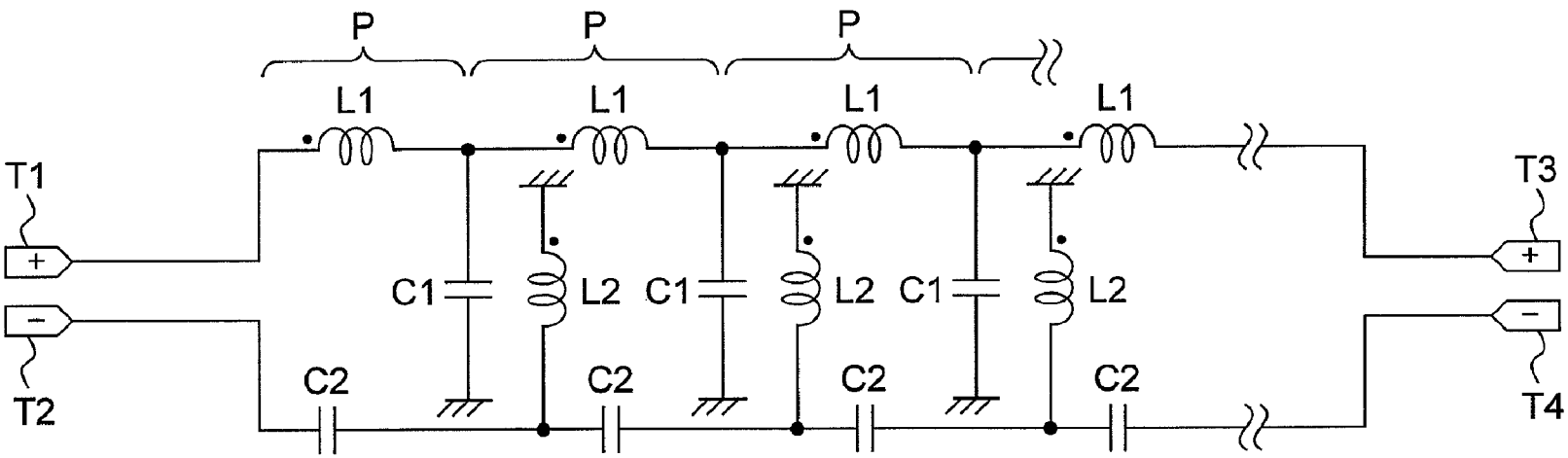
FIG. 3 is a circuit diagram showing an equivalent circuit to the microstrip line shown in FIGS. 1A to 1D.
Figure 4A:
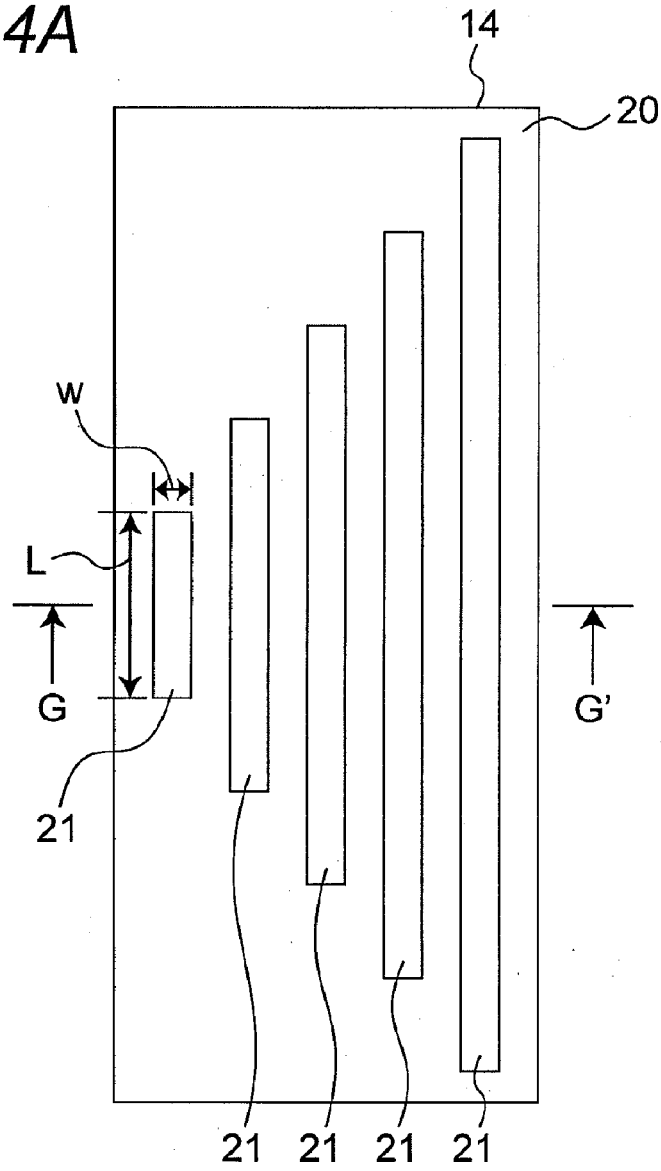
FIG. 4A is a plan view showing a detailed configuration of a conductor section 14 having a groove structure shown in FIGS. 1A to 1D.
Figure 4B:
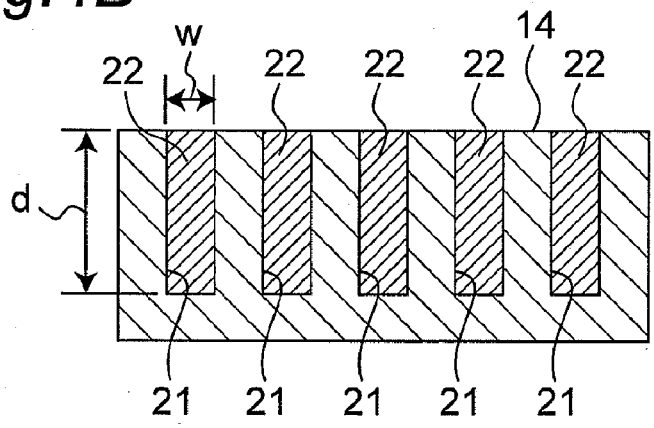
FIG. 4B is a longitudinal sectional view taken along a line G-G' shown in FIG. 4A.

The actions and advantageous effects of the conductor section 14 having the groove structure in which the conductor section 14 is configured as stated above and in which the conductor section 14 is a principal component of the present embodiment will be described with reference to FIGS. 3, 4A and 4B. FIG. 3 is a circuit diagram showing an equivalent circuit to the microstrip line shown in FIGS. 1A to 1D. FIG. 4A is a plan view showing a detailed configuration of the conductor section 14 having the groove structure shown in FIGS. 1A to 1D. FIG. 4B is a longitudinal sectional view taken along a line G-G' shown in FIG. 4A.

In the equivalent circuit having terminals T1, T2, T3, and T4 shown in FIG. 3, an inductor L1 represents an inductance of the strip conductor 12 and a capacitor C1 represents a capacitance between the strip conductor 12 and the grounding conductor 11. Further, a capacitor C2 represents a capacitance realized between opposing surfaces of groove walls of the conductor section 14. Moreover, an inductor L2 represents an inductance generated by flowing of an induced current, which flows in the grounding conductor 11, in the conductor section 14 having a groove structure that is conductive. The equivalent circuit is represented in a form of distributed constant circuit in which partial circuits P are cascaded by as much as a plurality of stages.

Referring to FIGS. 4A and 4B, each groove 21 has a width "w", a length "L" (FIG. 4A) and a depth "d" (FIG. 4B). In this case, as a method of changing the capacitor C2, the capacitor C2 can be changed by changing the length "L", the depth "d" and the width "w" of each groove 21, respectively. On the other hand, since the inductor L2 is decided by a distribution of the induced current flowing in the conductor section 14 having the groove structure, the inductor L2 can be set by changing relative values of the length "L" and the depth "d" of each groove 21. Further, changing the number of grooves 21 corresponds to changing the number of stages of partial circuits P in the equivalent circuit shown in FIG. 3.

As apparent from the equivalent circuit shown in FIG. 3, the microstrip line according to the present embodiment is characterized in that the inductors L2 and the capacitors C2, which are provided on a signal line in the metamaterial transmission line model shown in the Non-Patent Document 1 according to the prior art, are realized on the grounding conductor 11. By designing a circuit configuration of each of these partial circuits P of the equivalent circuit, it is possible to make frequency dispersion of a characteristic impedance of the entire microstrip line including a portion, in which the characteristic impedance changes, uniform in a wideband.

Figure 5A:
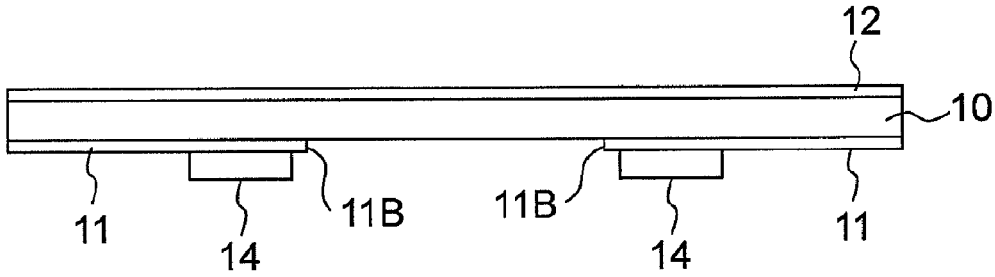
FIG. 5A is a front view showing a configuration of a simulation model (microstrip line transmission system) configured so that a pair of microstrip lines shown in FIGS. 1A to 1D is arranged to face each other and so that a grounding conductor is not present in a connection portion.
Figure 5B:
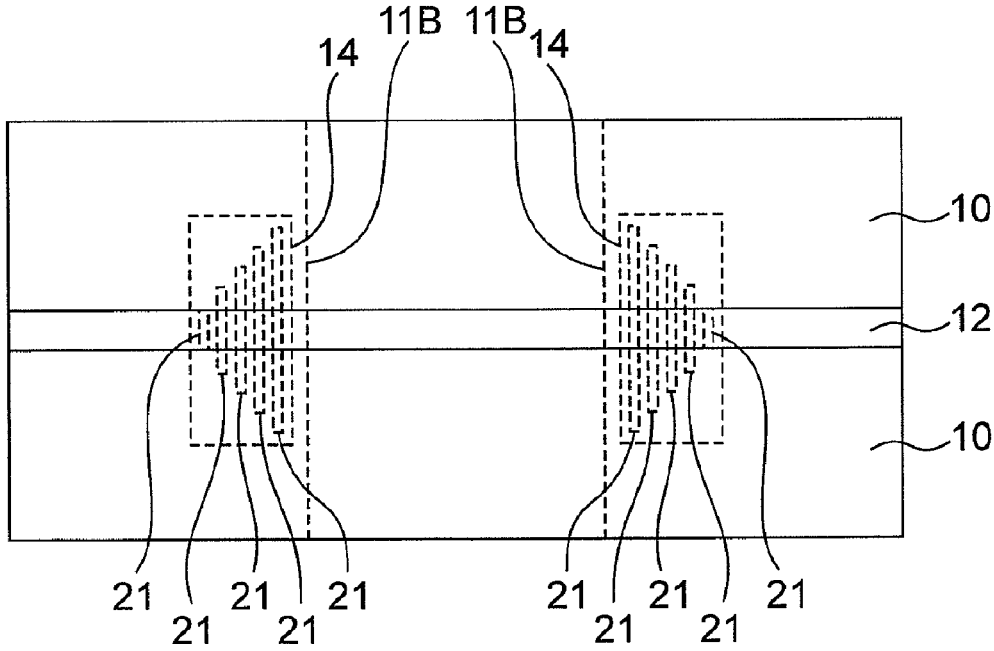
FIG. 5B is a plan view of the simulation model shown in FIG. 5A.

The actions and advantageous effects of the present embodiment will next be described with reference to FIGS. 5A, 5B and 6. FIG. 5A is a front view showing a configuration of a simulation model (microstrip line transmission system) configured so that a pair of microstrip lines shown in FIGS. 1A to 1D is arranged to face each other and so that a grounding conductor 11 is not present in a connection portion. FIG. 5B is a plan view of the simulation model shown in FIG. 5A.

Figure 6:
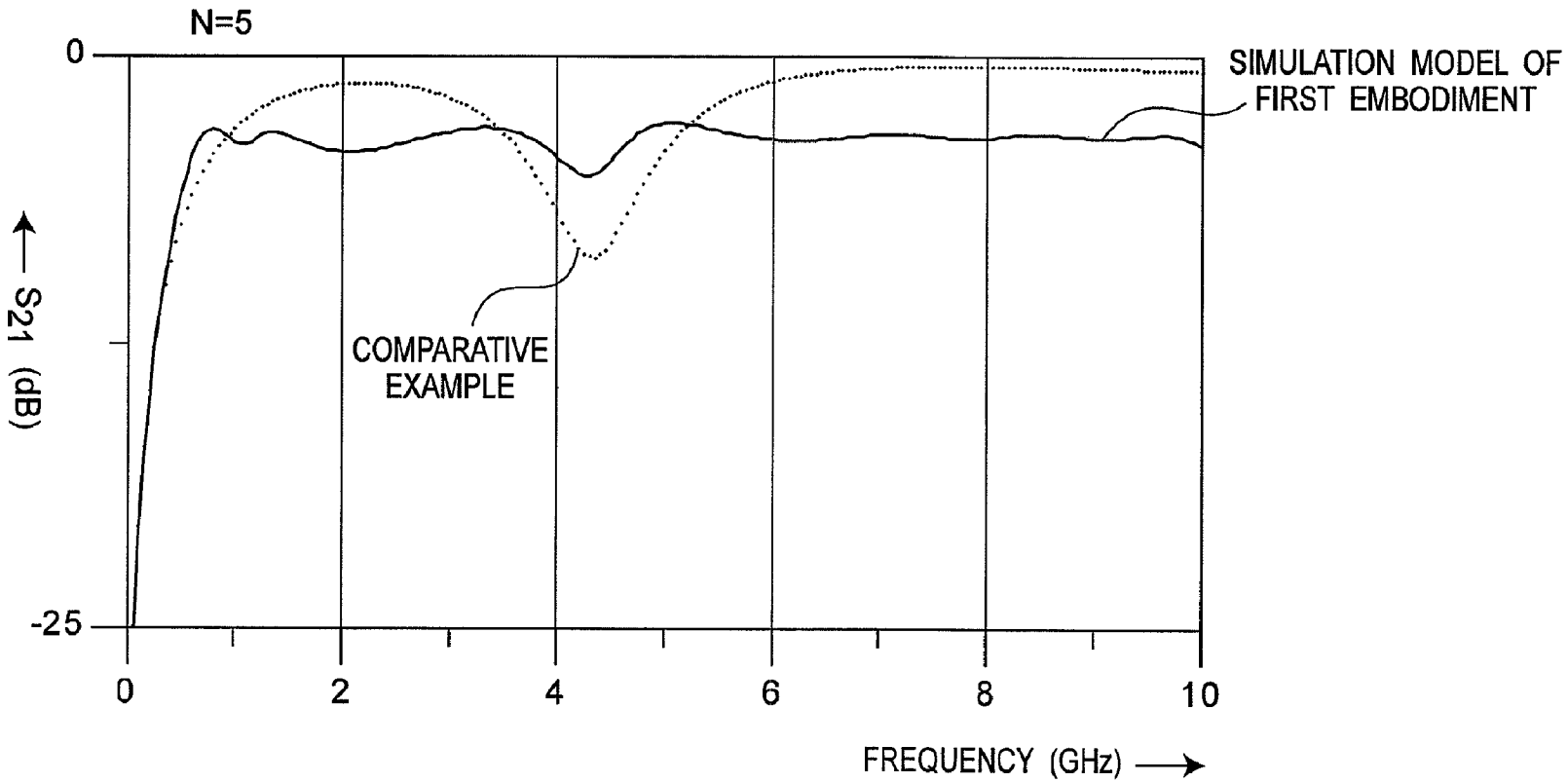
FIG. 6 is a spectral diagram showing a passing frequency characteristic of the simulation model shown in FIGS. 5A and 5B when the number N of grooves of the conductor section is 5, that is, N=5 and a passing frequency characteristic of a comparative example in which the conductor section is not provided in the simulation model of N=5.

FIG. 6 is a spectral diagram showing a passing frequency characteristic (solid line) of the simulation model shown in FIGS. 5A and 5B when the number N of grooves of the conductor section 14 is 5, that is, N=5 and a passing frequency characteristic (broken line) of a comparative example in which the conductor section 14 is not provided in the simulation model of N=5. The simulation model shown in FIGS. 5A and 5B is characterized in that the conductor section 14 having the groove structure, as stated in the embodiment, is provided in each of two portions that are edge portions 11B in which the grounding conductor 11 is missing and that are just before portions in which the characteristic impedance changes.

In this case, the simulation shown in FIG. 6 is made on an assumption of a case of transmitting a square wave having a basic frequency of 1 GHz. The frequencies of 3 GHz and 5 GHz serve as a third-order harmonic and a fifth-order harmonic with respect to the basic frequency, respectively. A condition in which the square wave has no distortion is that a passing characteristic is uniform at frequencies to such a degree. If the conductor section 14 having the groove structure according to the present embodiment is not provided, the passing frequency has a change to be equal to or higher than about 10 dB in a band of 1 GHz to 5 GHz. As a result, the square wave of a transmission signal is distorted. By contrast, according to the present embodiment, it is possible to suppress a change in the passing frequency to be equal to or lower than about 2 dB in this band. In this way, according to the present embodiment, it is possible to realize the microstrip line capable of making the passing characteristic uniform in the wideband and less frequent occurrence of distortions in the signal waveform even if the characteristic impedance of the microstrip line is discontinuous. It is noted that the spectral diagram shown in FIG. 6 contains (i) a y-axis label of "$S_{21}$ (dB)" representing a passing frequency characteristic in decibels of a signal waveform as described above and (ii) an x-axis label of "FREQUENCY (Ghz)" representing a frequency band in Ghz of a signal waveform as described above.

Figure 7A:
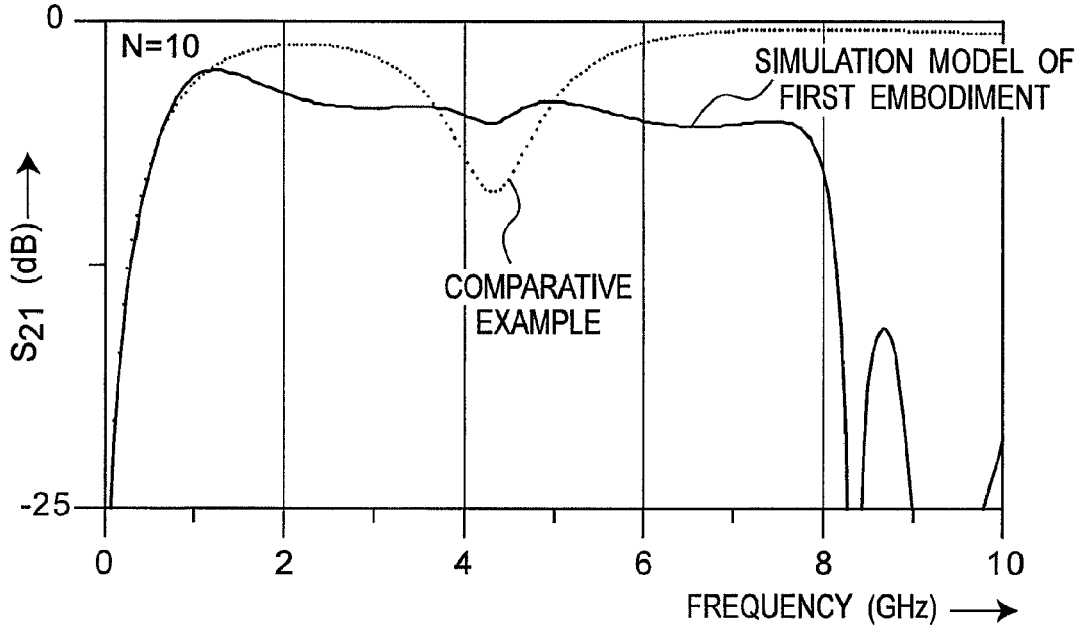
FIG. 7A is a spectral diagram showing a passing frequency characteristic of the simulation model shown in FIGS. 5A and 5B when the number N of grooves of the conductor section is 10, that is, N=10 and a passing frequency characteristic of a comparative example in which the conductor section is not provided in the simulation model of N=10.
Figure 7B:
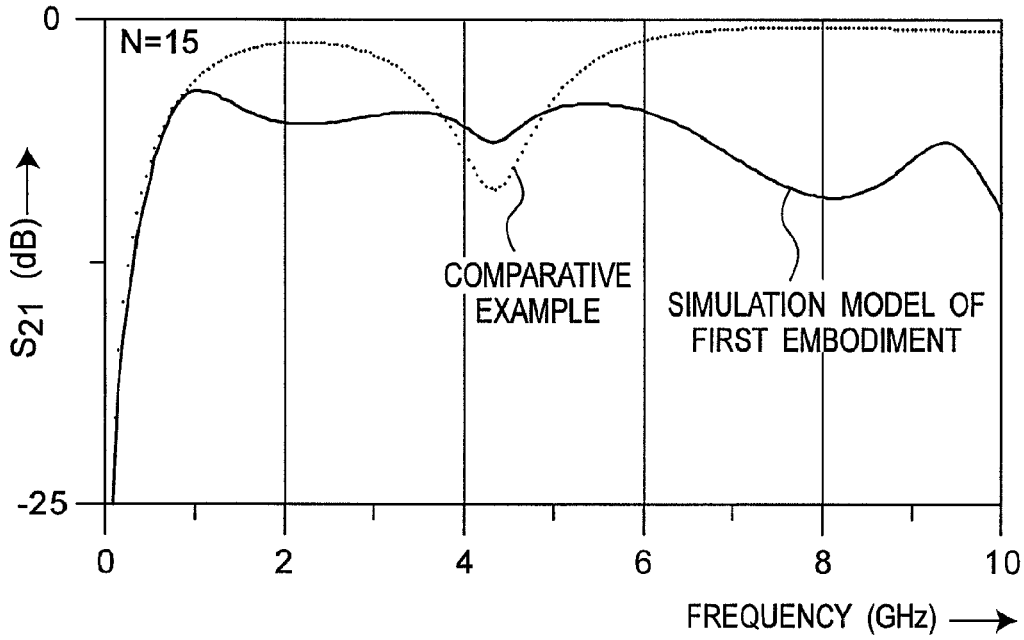
FIG. 7B is a spectral diagram showing a passing frequency characteristic of the simulation model shown in FIGS. 5A and 5B when the number N of grooves of the conductor section is 15, that is, N=15 and a passing frequency characteristic of a comparative example in which the conductor section is not provided in the simulation model of N=15.

Furthermore, the fact that a frequency band of the passing characteristic can be changed by changing the number N of grooves 21 will be described with reference to FIGS. 7A and 7B. FIG. 7A is a spectral diagram showing a passing frequency characteristic (solid line) of the simulation model shown in FIGS. 5A and 5B when the number N of grooves of the conductor section 14 is 10, that is, N=10 and a passing frequency characteristic (broken line) of a comparative example in which the conductor section 14 is not provided in the simulation model of N=10. FIG. 7B is a spectral diagram showing a passing frequency characteristic of the simulation model shown in FIGS. 5A and 5B when the number N of grooves of the conductor section 14 is 15, that is, N=15 and a passing frequency characteristic of a comparative example in which the conductor section 14 is not provided in the simulation model of N=15. In FIGS. 7A and 7B, it is assumed that the conductor sections 14 have a uniform size. As apparent from FIGS. 7A and 7B, the band in which the passing characteristic is uniform can be changed by increasing the number of grooves 21 of each conductor section 14. It is noted that the spectral diagrams shown in FIGS. 7A and 7B contain (i) a y-axis label of "$S_{21}$ (dB)" representing a passing frequency characteristic in decibels of a signal waveform as described above and (ii) an x-axis label of "FREQUENCY (Ghz)" representing a frequency band in Ghz of a signal waveform as described above.

While the grooves 21 of each conductor section 14 having the groove structure is formed by filling up the dielectric substances 22 identical in a material to the dielectric substrate 10 according to the present embodiment, the grooves 21 may be constituted by including dielectric substances made of a different material or may be cavities. This case corresponds to changing of a capacitance of each capacitor C2 in the equivalent circuit shown in FIG. 3.

Second Embodiment

Figure 8A:
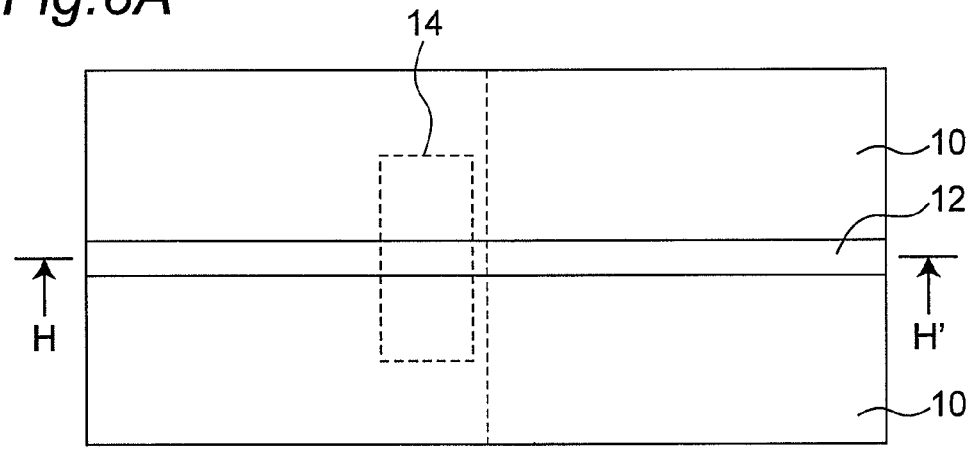
FIG. 8A is a plan view showing a configuration of a microstrip line according to a second embodiment of the present invention.
Figure 8B:
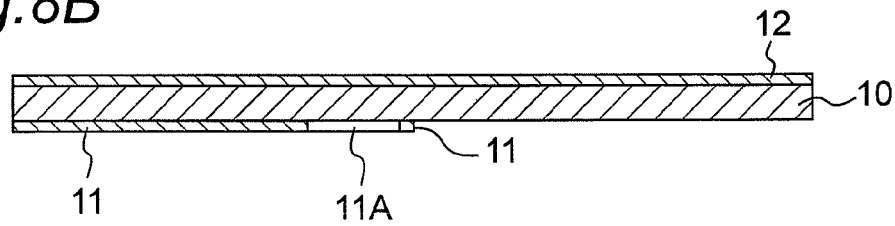
FIG. 8B is a longitudinal sectional view taken along a line H-H' shown in FIG. 8A.
Figure 8C:
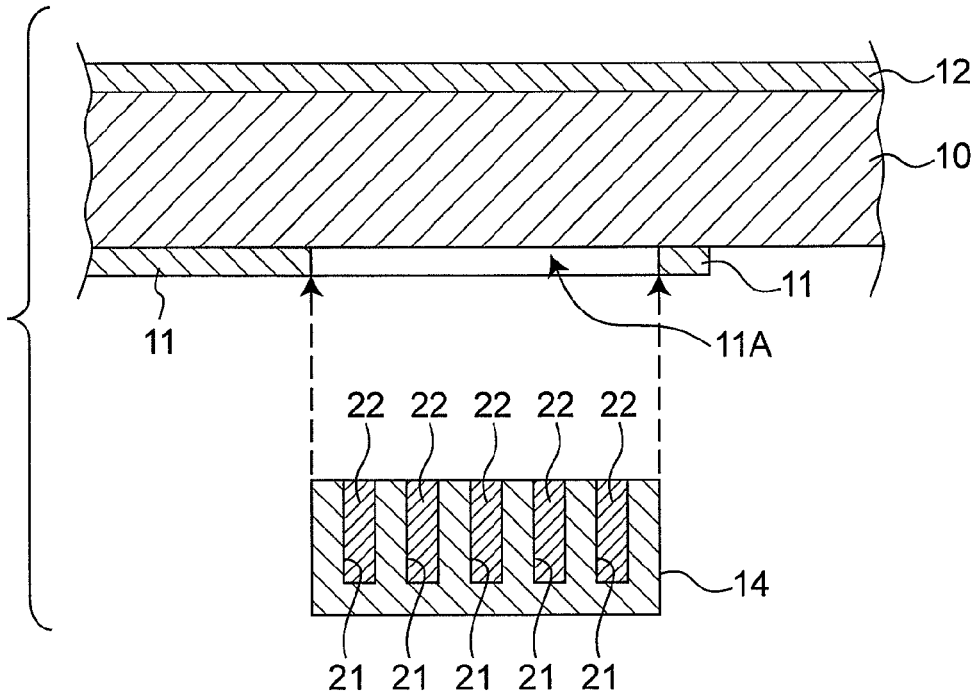
FIG. 8C is an enlarged view of principal parts shown in FIG. 8B.
Figure 9:
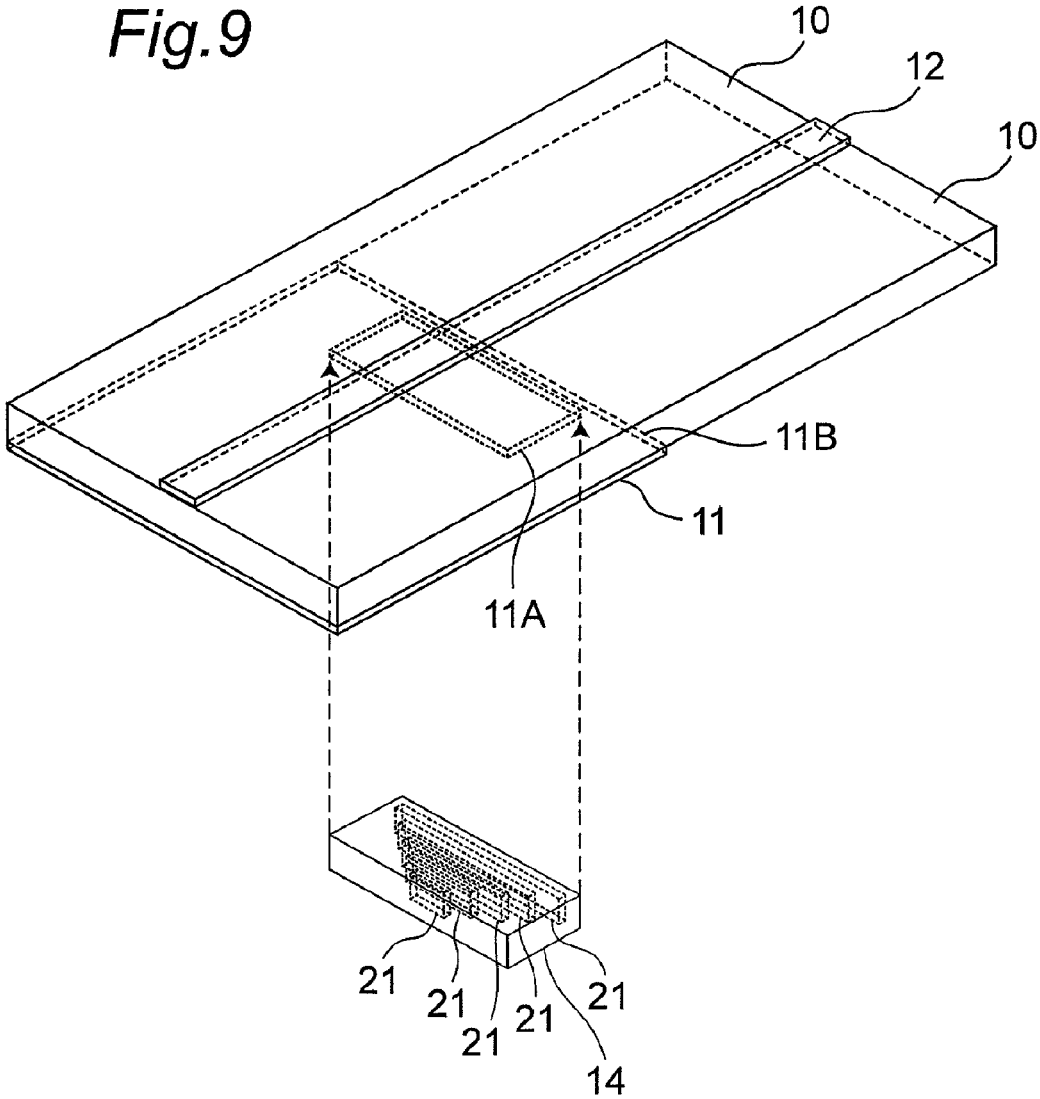
FIG. 9 is a perspective view of the microstrip line shown in FIGS. 8A to 8C.

FIG. 8A is a plan view showing a configuration of a microstrip line according to a second embodiment of the present invention. FIG. 8B is a longitudinal sectional view taken along a line H-H' shown in FIG. 8A. FIG. 8C is an enlarged view of principal parts shown in FIG. 8B. FIG. 9 is a perspective view of the microstrip line shown in FIGS. 8A to 8C.

Referring to FIGS. 8A to 8C and 9, the microstrip line according to the second embodiment is characterized by being configured so that a component or part that serves as a conductor section 14 (FIGS. 8A, 8C, and 9) having a groove structure is formed in advance without forming the conductor section 14 having the groove structure integrally with the grounding conductor 11 (FIGS. 8B, 8C, and 9) by providing the conductor section 14 on the grounding conductor 11 as described in the first embodiment, an opening 11A (FIGS. 8B, 8C, and 9) identical in magnitude to the component or part that serves as the conductor section 14 is formed in the grounding conductor 11, and so that the component or part that serves as the conductor section 14 having the groove structure is inserted into the opening 11A. Additionally, FIG. 9 shows the edge portion 11B of the grounding conductor 11.

Figure 10A:
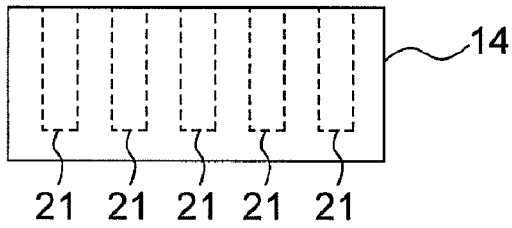
FIG. 10A is a front view showing a detailed configuration of a conductor section 14 shown in FIGS. 8A to 8C.
Figure 10B:
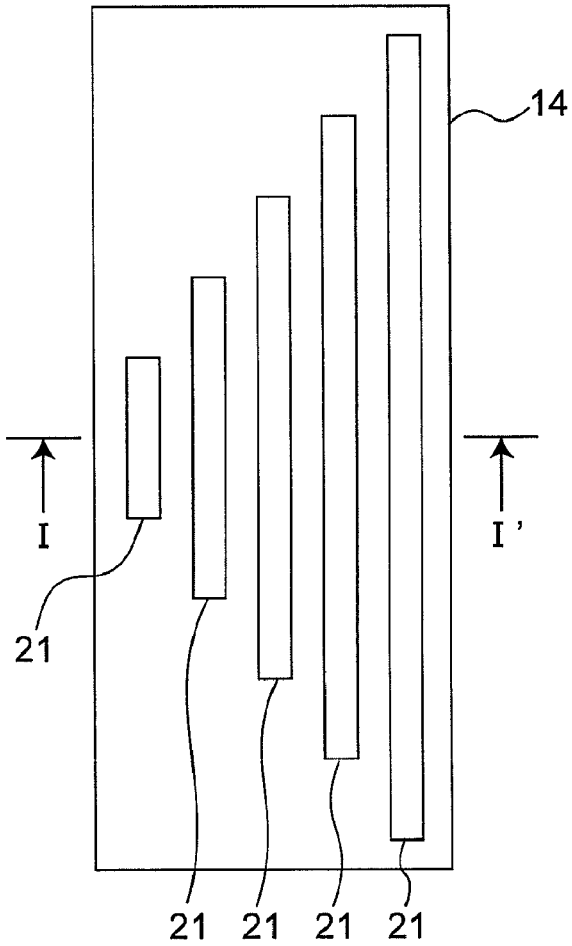
FIG. 10B is a plan view of the conductor section shown in FIG. 10A.
Figure 10C:
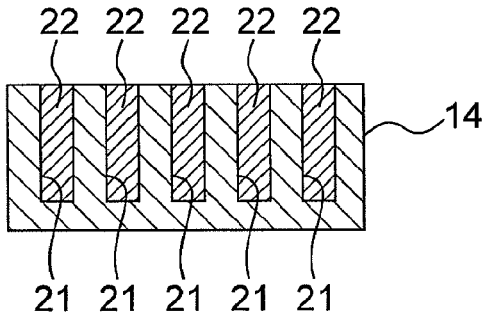
FIG. 10C is a longitudinal sectional view taken along a line I-I' shown in FIG. 10B.
Figure 11A:
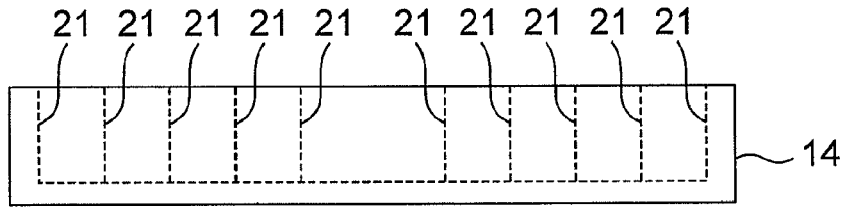
FIG. 11A is a side view of the conductor section shown in FIGS. 10A to 10C.
Figure 11B:
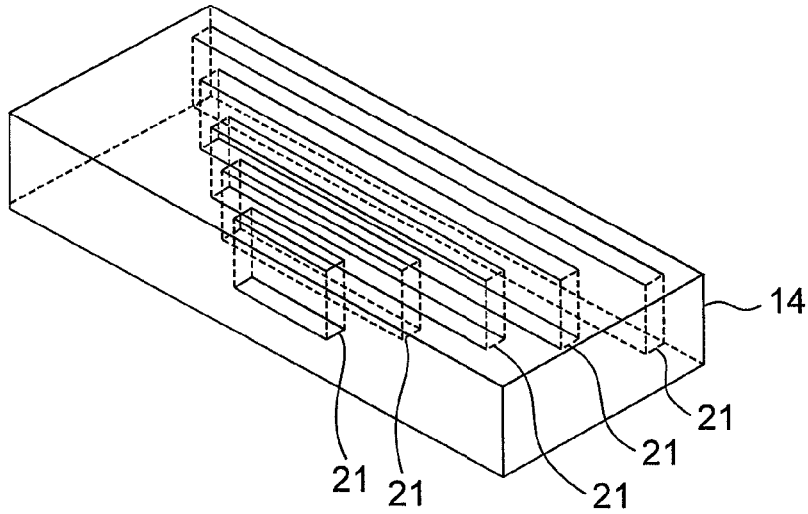
FIG. 11B is a perspective view of the conductor section shown in FIGS. 10A to 10C.

FIG. 10A is a front view showing a detailed configuration of the conductor section 14 shown in FIGS. 8A to 8C. FIG. 10B is a plan view of the conductor section 14 shown in FIG. 10A. FIG. 10C is a longitudinal sectional view taken along a line I-I' shown in FIG. 10B. In addition, FIG. 11A is a side view of the conductor section 14 shown in FIGS. 10A to 10C and FIG. 11B is a perspective view of the conductor section 14 shown in FIGS. 10A to 10C. In this case, FIGS. 10A to 10C and FIGS. 11A to 11B are pattern views for describing a configuration of the component or part that serves as the conductor section 14 having the groove structure according to the present embodiment, and the configuration thereof is similar to that of the conductor section 14 according to the first embodiment.

According to the second embodiment configured as stated above, the configuration described in the first embodiment can be realized by adding the component or part that serves as the conductor section 14 having the groove structure instead of forming the conductor section 14 integrally with a substrate. The second embodiment can exhibit actions and advantageous effects similar to those described in the first embodiment. In the present second embodiment, in a manner similar to that of the first embodiment, each groove 21 may be formed by either filling up a dielectric substance 22 (FIG. 10C) or by a cavity such as the air. As the dielectric substance, the dielectric substance 22 made of the same material as that of a dielectric substrate 10 or the dielectric substance 22 made of a different material from that of the dielectric substrate 10 may be used.

Modified Embodiments of Second Embodiment

Figure 12A:
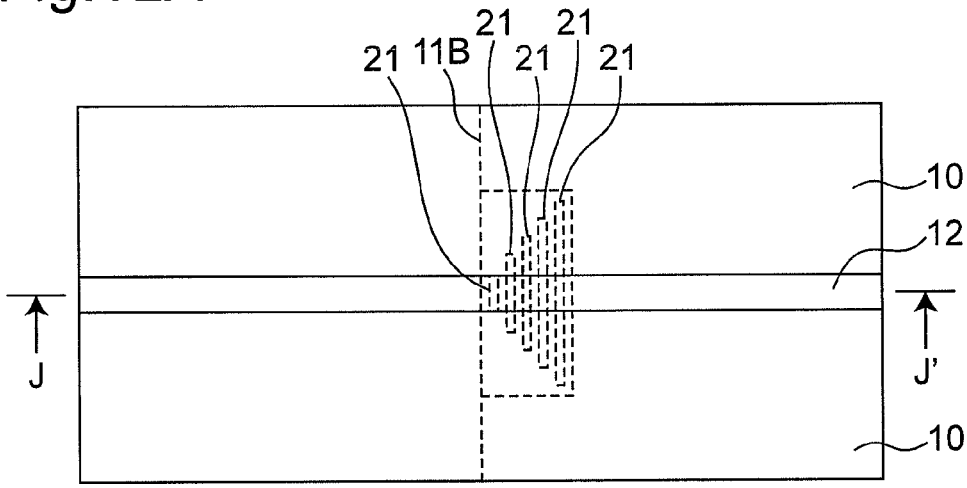
FIG. 12A is a plan view showing a configuration of a microstrip line according to a modified embodiment of the second embodiment of the present invention.
Figure 12B:
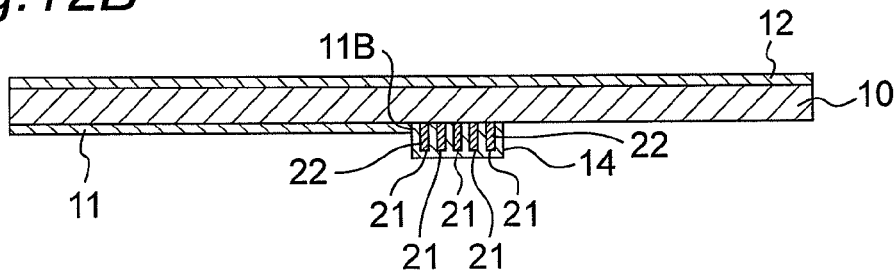
FIG. 12B is a longitudinal sectional view taken along a line J-J' shown in FIG. 12A.
Figure 12C:
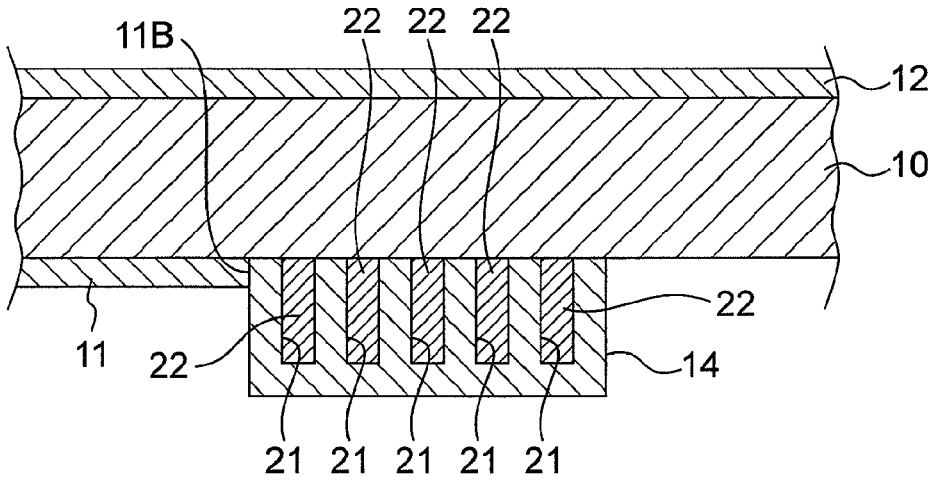
FIG. 12C is an enlarged view of principal parts shown in FIG. 12B.
Figure 13A:
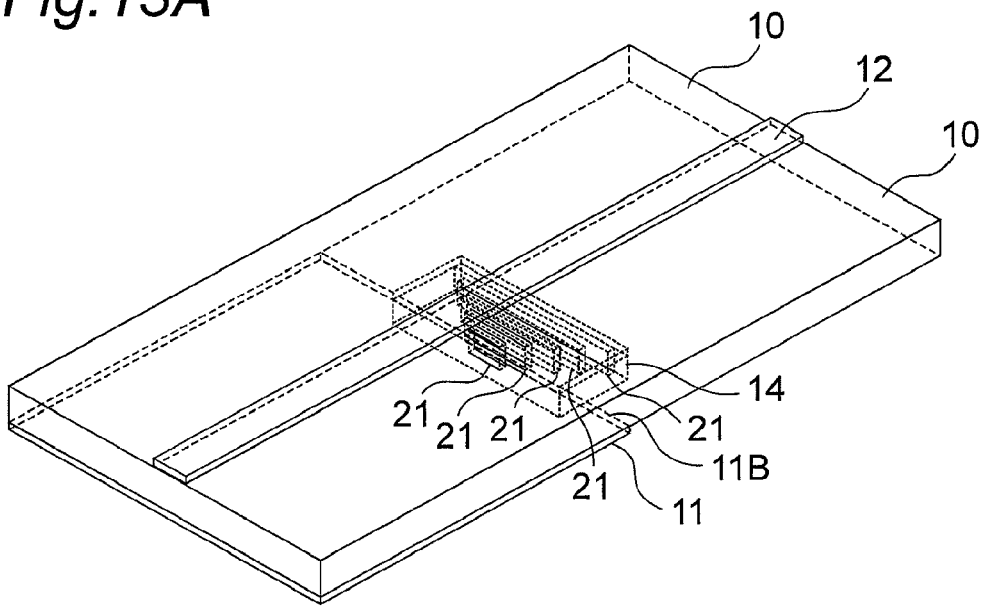
FIG. 13A is a perspective view of the microstrip line shown in FIGS. 12A to 12C.
Figure 13B:
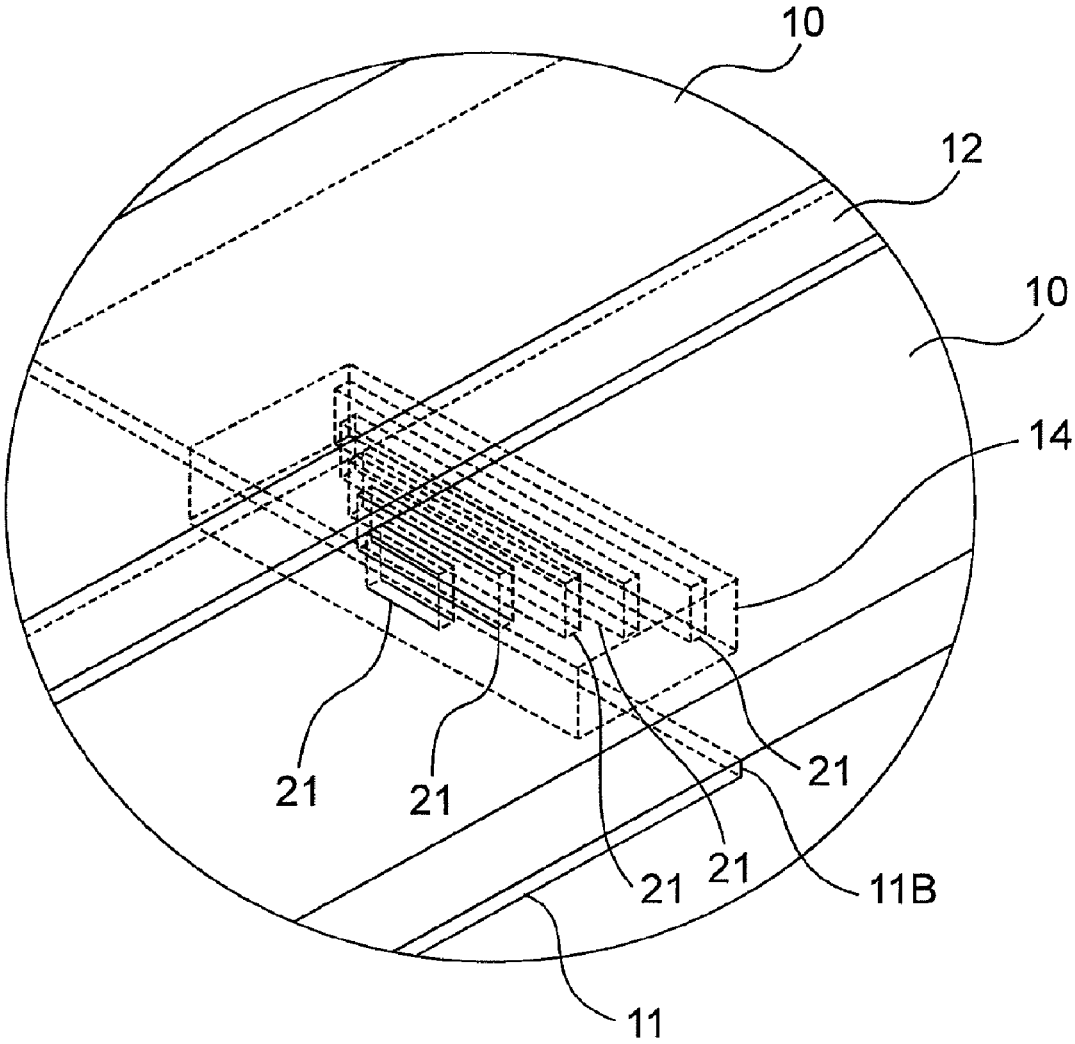
FIG. 13B is an enlarged view of principal parts shown in FIG. 13A.

FIG. 12A is a plan view showing a configuration of a microstrip line according to a modified embodiment of the second embodiment of the present invention. FIG. 12B is a longitudinal sectional view taken along a line J-J' shown in FIG. 12A. FIG. 12C is an enlarged view of principal parts shown in FIG. 12B. FIG. 13A is a perspective view of the microstrip line shown in FIGS. 12A to 12C and FIG. 13B is an enlarged view of principal parts shown in FIG. 13A. Referring to FIGS. 12A to 12C and FIGS. 13A and 13B, a component or part that serves as a conductor section 14 having a groove structure is characteristically arranged right under the strip conductor 12 so as to contact with an edge portion 11B (FIGS. 12B, 12C, 13A, and 13B) of the grounding conductor 11. By thus configuring the microstrip line, there is no need to form an opening 11A provided in the grounding conductor 11.

Figure 14:
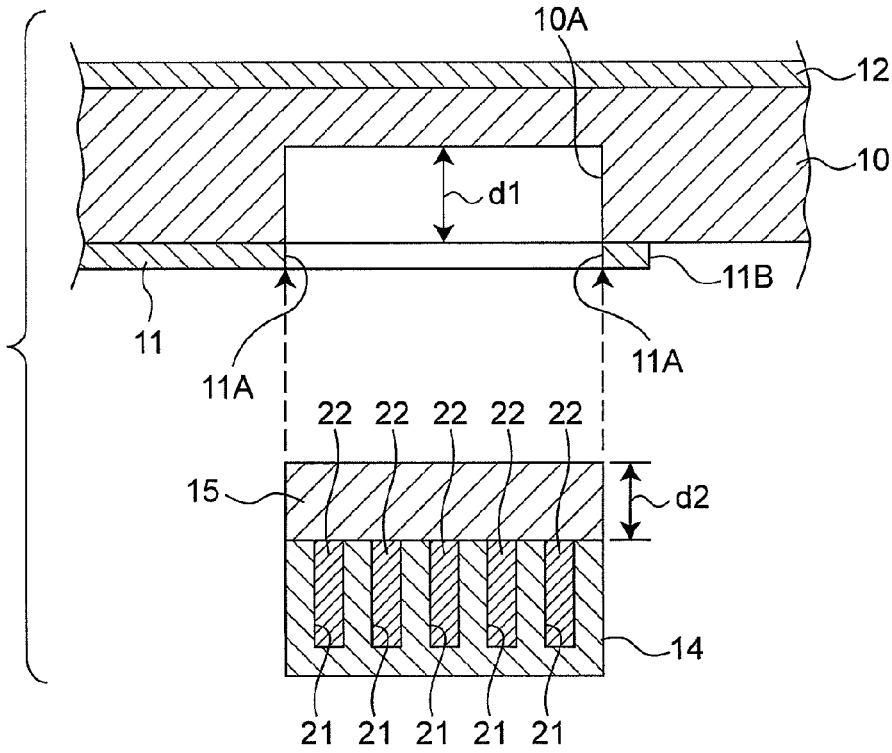
FIG. 14 is an enlarged longitudinal sectional view of principal parts of a microstrip line according to another modified embodiment of the second embodiment of the present invention.
Figure 15:
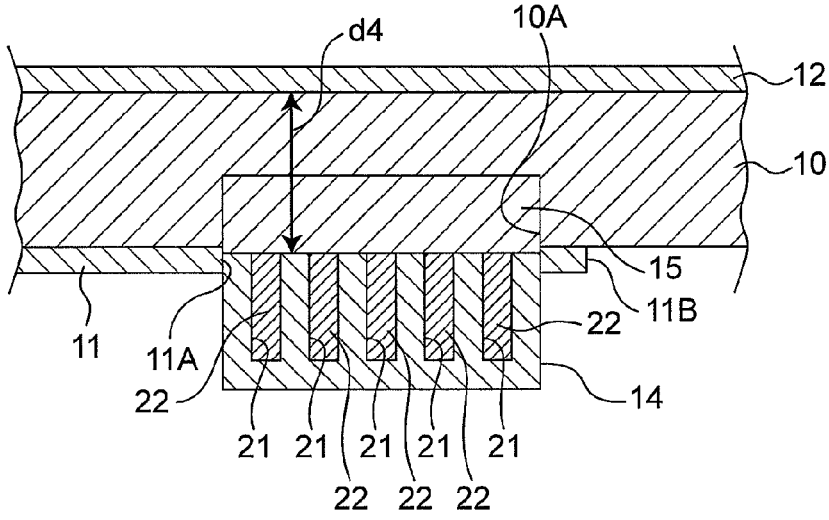
FIG. 15 is a longitudinal sectional view of the microstrip line when a conductor section shown in FIG. 14 is engaged into an opening 10A of a dielectric substrate 10.
Figure 16:
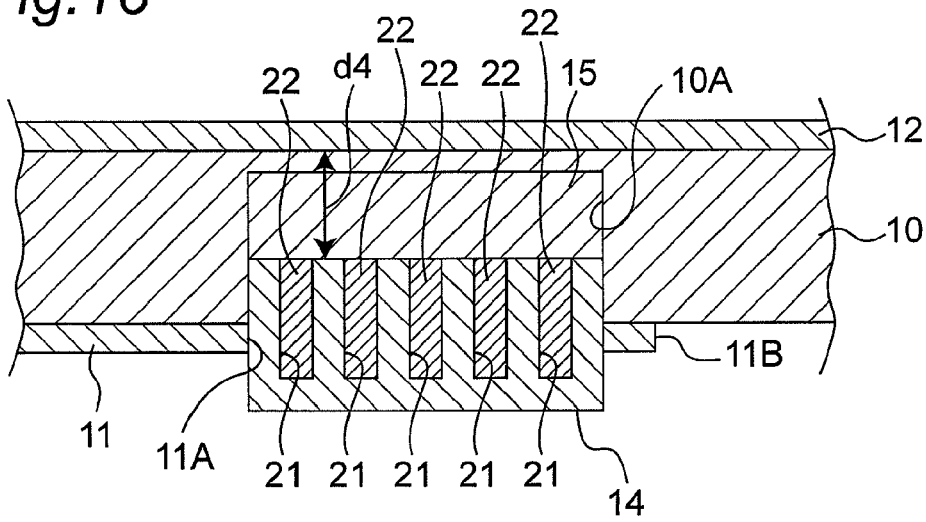
FIG. 16 is an enlarged longitudinal sectional view showing a configuration of a microstrip line according to a further modified embodiment of the microstrip line shown in FIG. 15.

FIG. 14 is an enlarged longitudinal sectional view of principal parts of a microstrip line according to another modified embodiment of the second embodiment of the present invention. FIG. 15 is a longitudinal sectional view of the microstrip line when a conductor section 14 shown in FIG. 14 is engaged into an opening 10A of a dielectric substrate 10A. FIG. 16 is an enlarged longitudinal sectional view showing a configuration of a microstrip line according to a further modified embodiment of the microstrip line shown in FIG. 15.

Referring to FIG. 14, the microstrip line according to another modified embodiment of the second embodiment is characterized in that a component or part configured so that a rectangular parallelepiped dielectric section 15 (identical in a plane shape to a conductor section 14) is mounted on an upper portion of the conductor section 14 is inserted and engaged into an opening 11A of the grounding conductor 11 and the opening 10A of the dielectric substrate 10. In this case, as shown in FIGS. 15 and 16, it is possible to decide a distance "d4" between the strip conductor 12 and the conductor section 14 having the groove structure, depending on a depth "d1" of the opening 10A of the dielectric substrate 10 and a height "d2" of the dielectric section 15 as shown in FIG. 14. This corresponds to the fact that the microstrip line according to the present embodiment has such an advantageous effect as changing the capacitors C1 in the equivalent circuit for describing the present invention shown in FIG. 3. Moreover, as shown in FIGS. 12A to 12C and FIGS. 13A and 13B, this configuration can be similarly applied to an instance of providing the configuration in a portion in which the grounding conductor 11 is not present on the dielectric substrate 10.

Third Embodiment

Figure 17A:
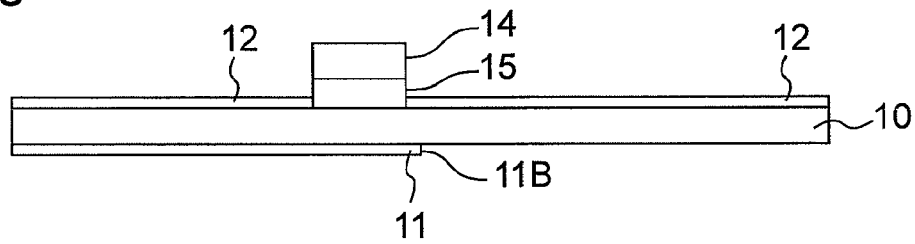
FIG. 17A is a front view showing a configuration of a microstrip line according to a third embodiment of the present invention.
Figure 17B:
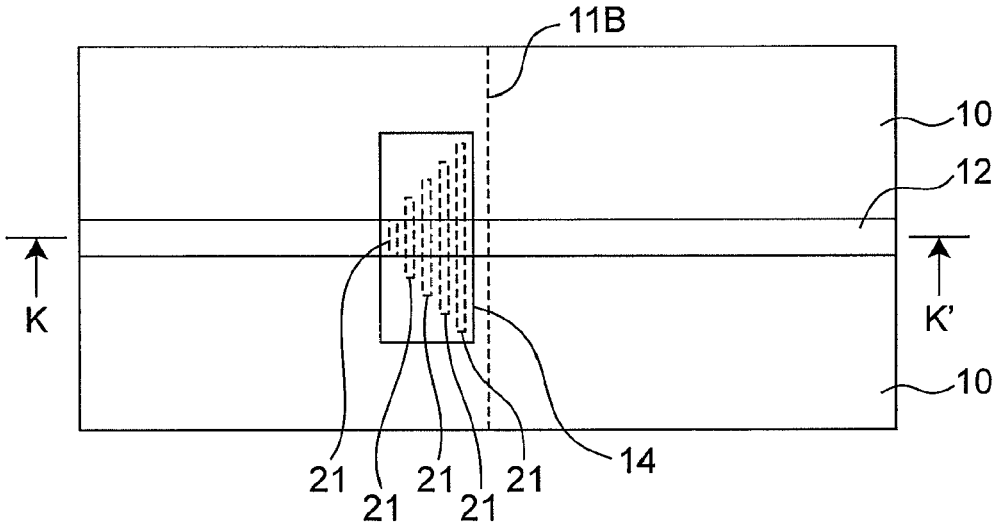
FIG. 17B is a plan view of the microstrip line shown in FIG. 17A.
Figure 17C:
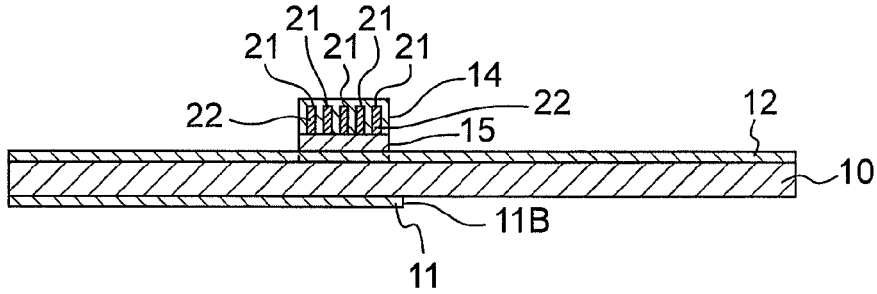
FIG. 17C is a longitudinal sectional view taken along a line K-K' shown in FIG. 17B.
Figure 17D:
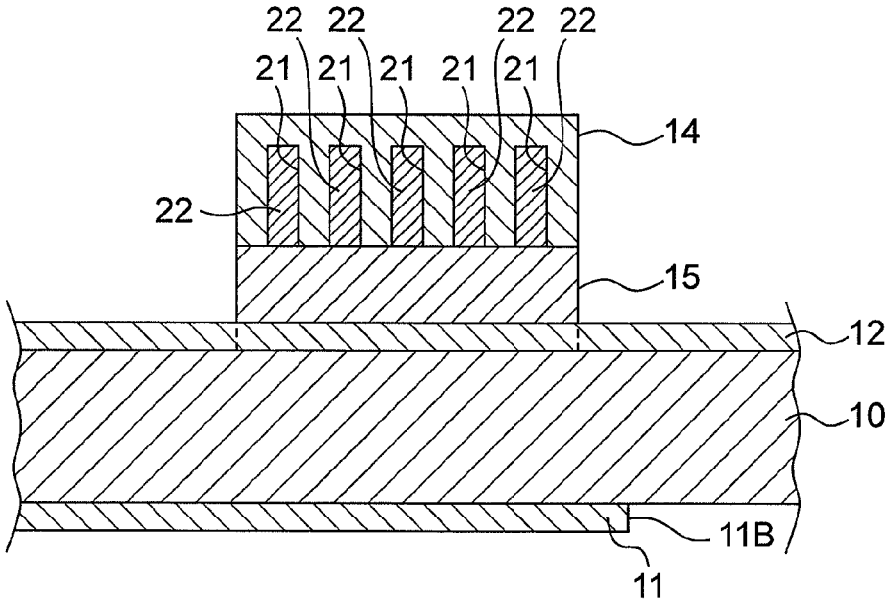
FIG. 17D is an enlarged view of principal parts shown in FIG. 17C.
Figure 18A:
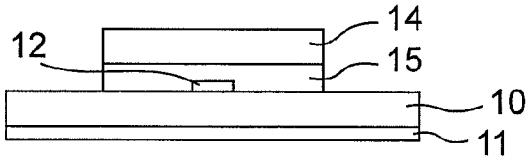
FIG. 18A is a side view of the microstrip line shown in FIGS. 17A to 17D.
Figure 18B:
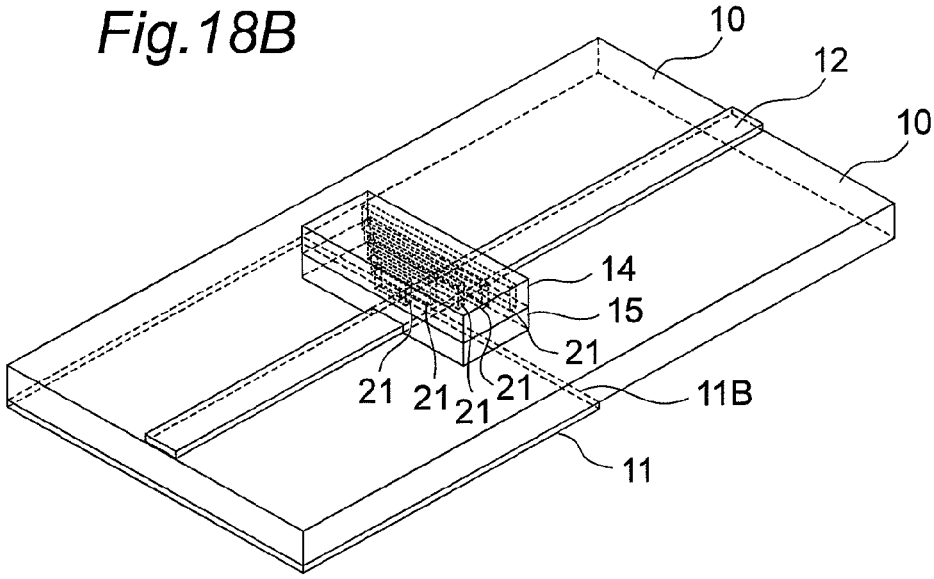
FIG. 18B is a perspective view of the microstrip line shown in FIGS. 17A to 17D.
Figure 18C:
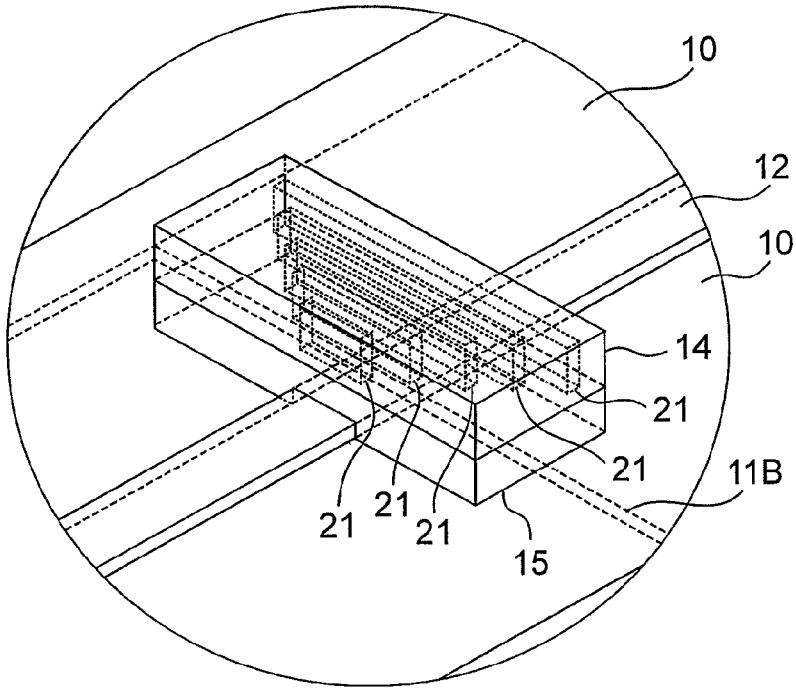
FIG. 18C is an enlarged view of principal parts shown in FIG. 17B.

FIG. 17A is a front view showing a configuration of a microstrip line according to a third embodiment of the present invention. FIG. 17B is a plan view of the microstrip line shown in FIG. 17A. FIG. 17C is a longitudinal sectional view taken along a line K-K' shown in FIG. 17B. FIG. 17D is an enlarged view of principal parts shown in FIG. 17C. FIG. 18A is a side view of the microstrip line shown in FIGS. 17A to 17D. FIG. 18B is a perspective view of the microstrip line shown in FIGS. 17A to 17D. FIG. 18C is an enlarged view of principal parts shown in FIG. 17B.

Referring to FIGS. 17A to 17D and FIGS. 18A to 18C, the present embodiment is characterized by arranging a component or part that serves as the conductor section 14 having the groove structure according to the second embodiment on the strip conductor 12 via the dielectric section 15 (FIGS. 16, 17A, 17C, 17D, and 18A to 18C). In the third embodiment configured as stated above, the component or part that serves as the conductor section 14 having the groove structure is not conductive to a grounding conductor 11 (FIGS. 17A, 17C, 17D, 18A, and 18B) while the component or part that serves as the conductor section 14 having the groove structure is conductive to the grounding conductor 11 in the configuration according to the second embodiment. Nevertheless, the third embodiment exhibits actions and advantageous effects similar to those of the second embodiment in a respect that an electromagnetic field generated by an electric signal flowing in the strip conductor 12 enables an induced current to flow in the component or part that serves as the conductor section 14 having the groove structure.

Figure 19A:
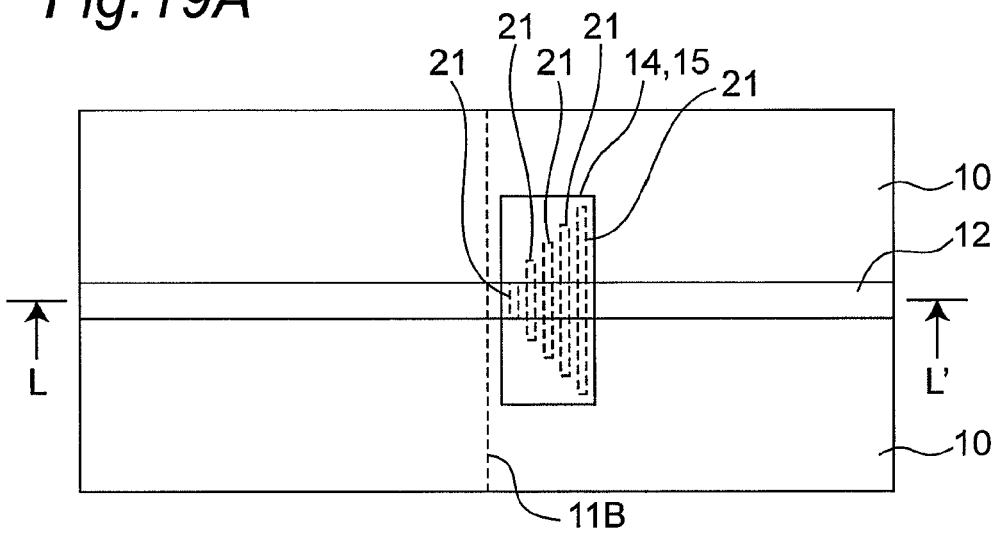
FIG. 19A is a front view showing a configuration of a microstrip line according to a modified embodiment of the third embodiment of the present invention.
Figure 19B:
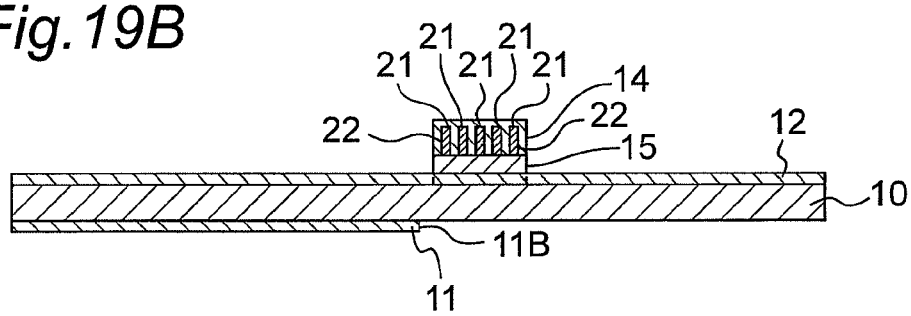
FIG. 19B is a longitudinal sectional view taken along a line L-L' shown in FIG. 19A.
Figure 19C:
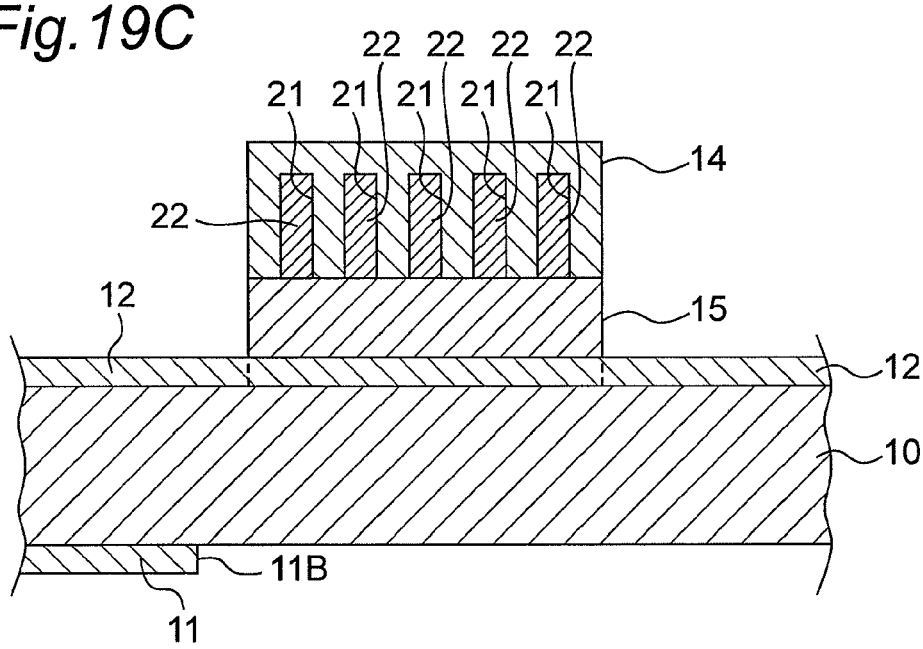
FIG. 19C is an enlarged view of principal parts shown in FIG. 19B.
Figure 20A:
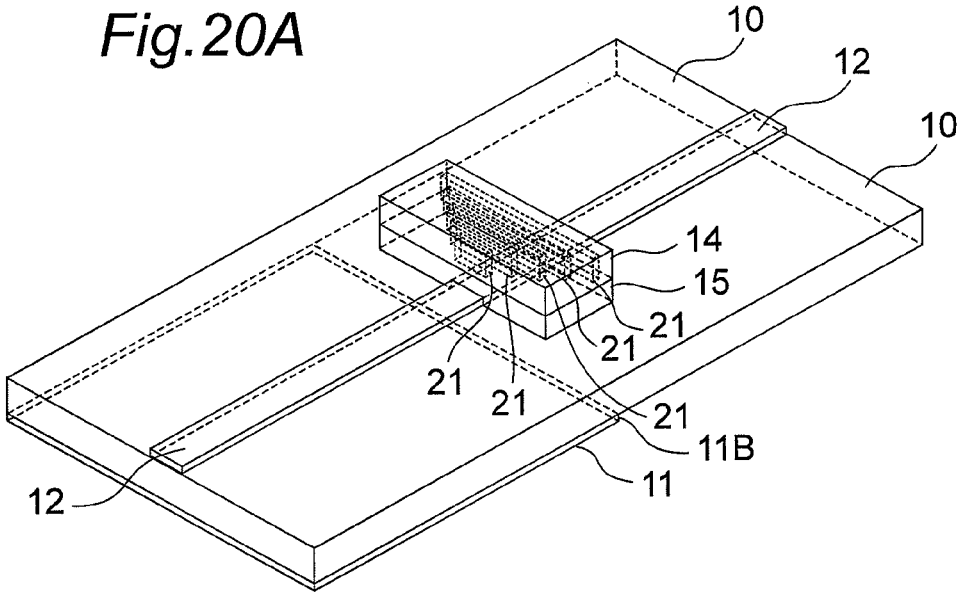
FIG. 20A is a perspective view of the microstrip line shown in FIGS. 19A to 19C.
Figure 20B:
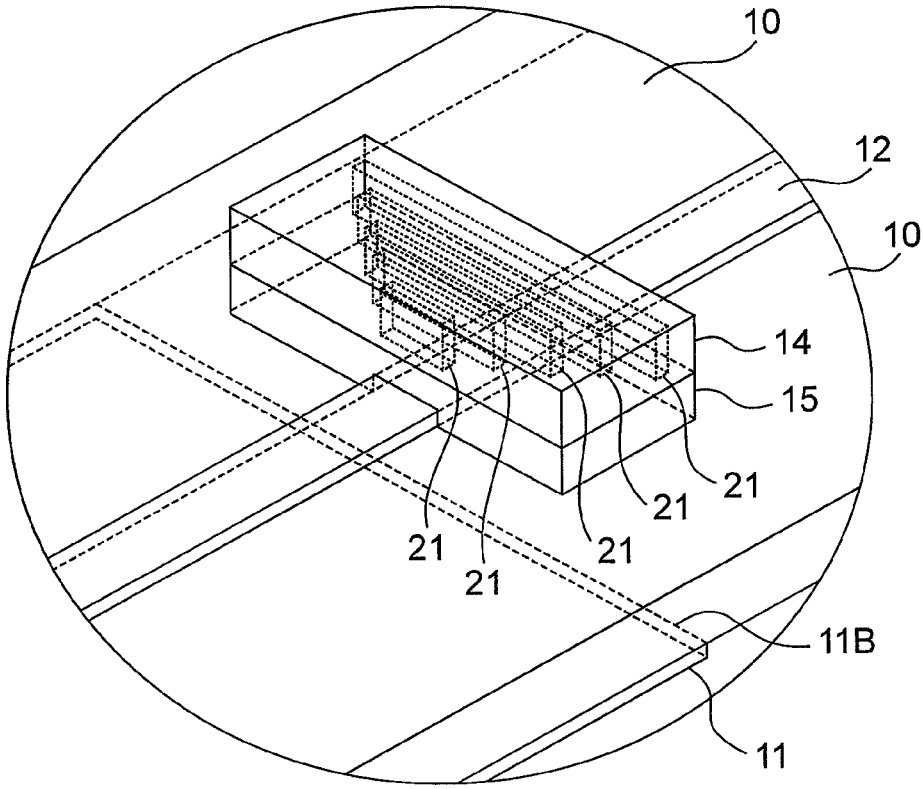
FIG. 20B is an enlarged view of principal parts shown in FIG. 20A.

FIG. 19A is a front view showing a configuration of a microstrip line according to a modified embodiment of the third embodiment of the present invention. FIG. 19B is a longitudinal sectional view taken along a line L-L' shown in FIG. 19A. FIG. 19C is an enlarged view of principal parts shown in FIG. 19B. FIG. 20A is a perspective view of the microstrip line shown in FIGS. 19A to 19C. FIG. 20B is an enlarged view of principal parts shown in FIG. 20A. According to the present embodiment, the conductor section 14 (FIGS. 19B, 19C, 20A and 20B) having the groove can be arranged at an arbitrary location on a microstrip line. As shown in FIGS. 19A to 19C and FIGS. 20A and 20B, the conductor section 14 (FIGS. 19B, 19C, 20A and 20B) can be provided even in a portion on a front surface of the dielectric substrate 10 and on that of the strip conductor 12 just right under which the grounding conductor 11 (FIGS. 19B, 19C, 20A and 20B) is not present.

Figure 21A:
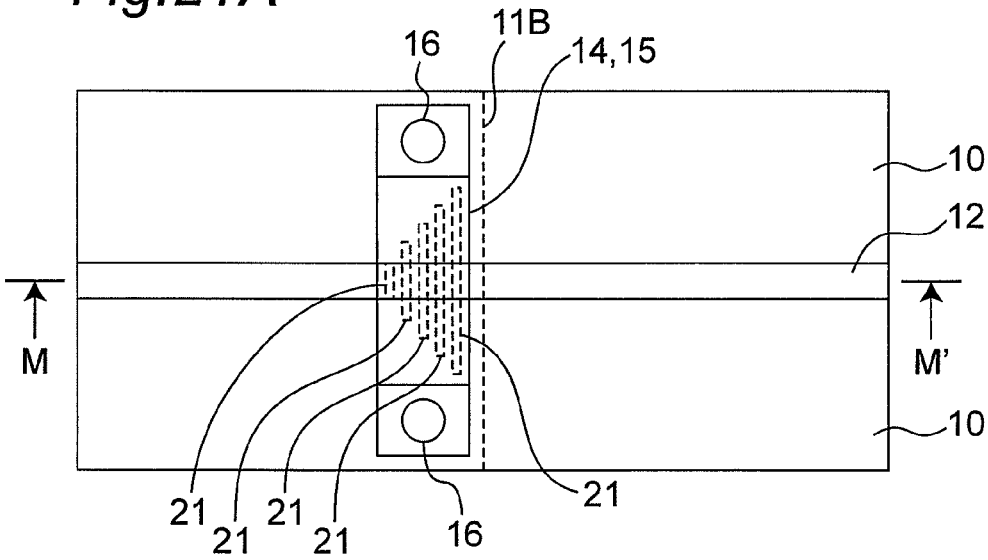
FIG. 21A is a front view showing a configuration of a microstrip line according to another modified embodiment of the third embodiment of the present invention.
Figure 21B:
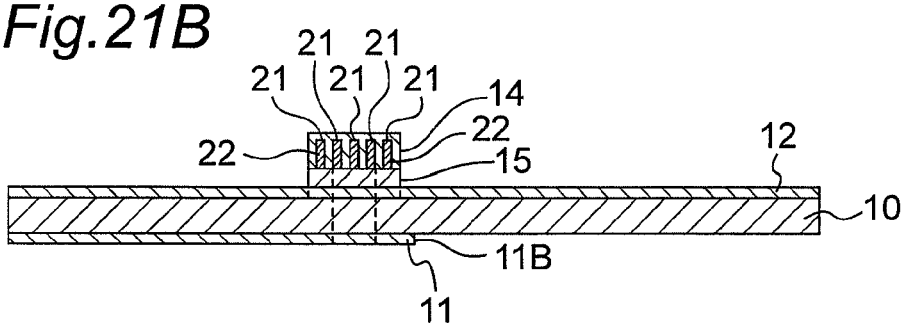
FIG. 21B is a longitudinal sectional view taken along a line M-M' shown in FIG. 21A.
Figure 21C:
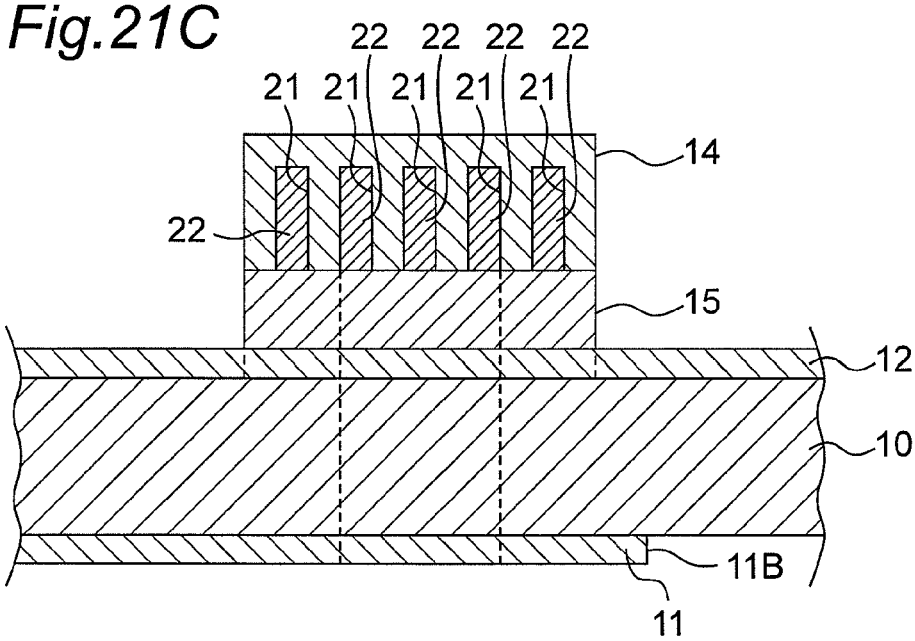
FIG. 21C is an enlarged view of principal parts shown in FIG. 21B.
Figure 22A:
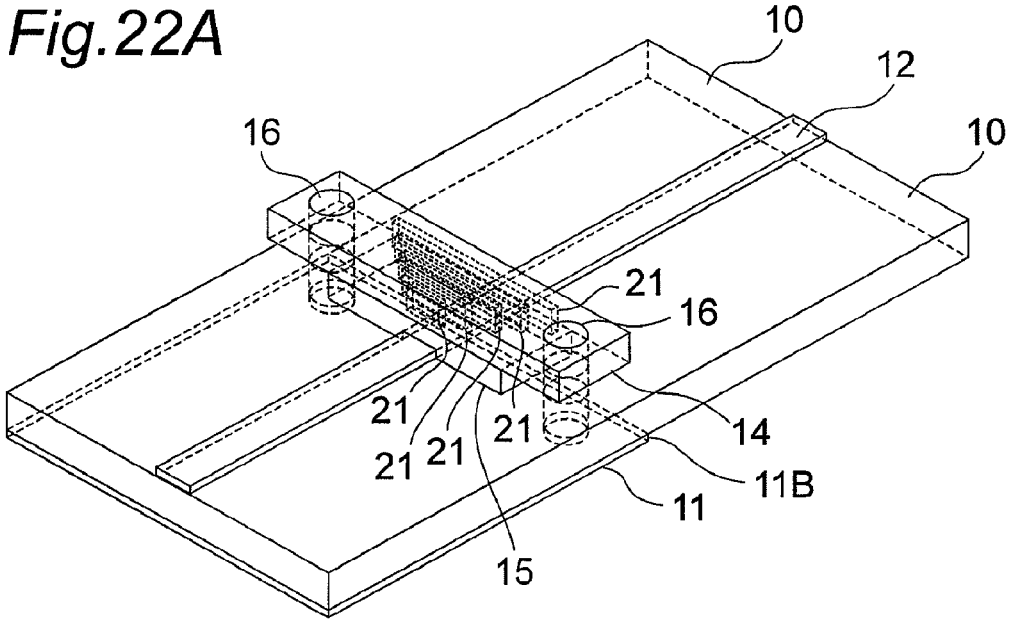
FIG. 22A is a perspective view of the microstrip line shown in FIGS. 21A to 21C.
Figure 22B:
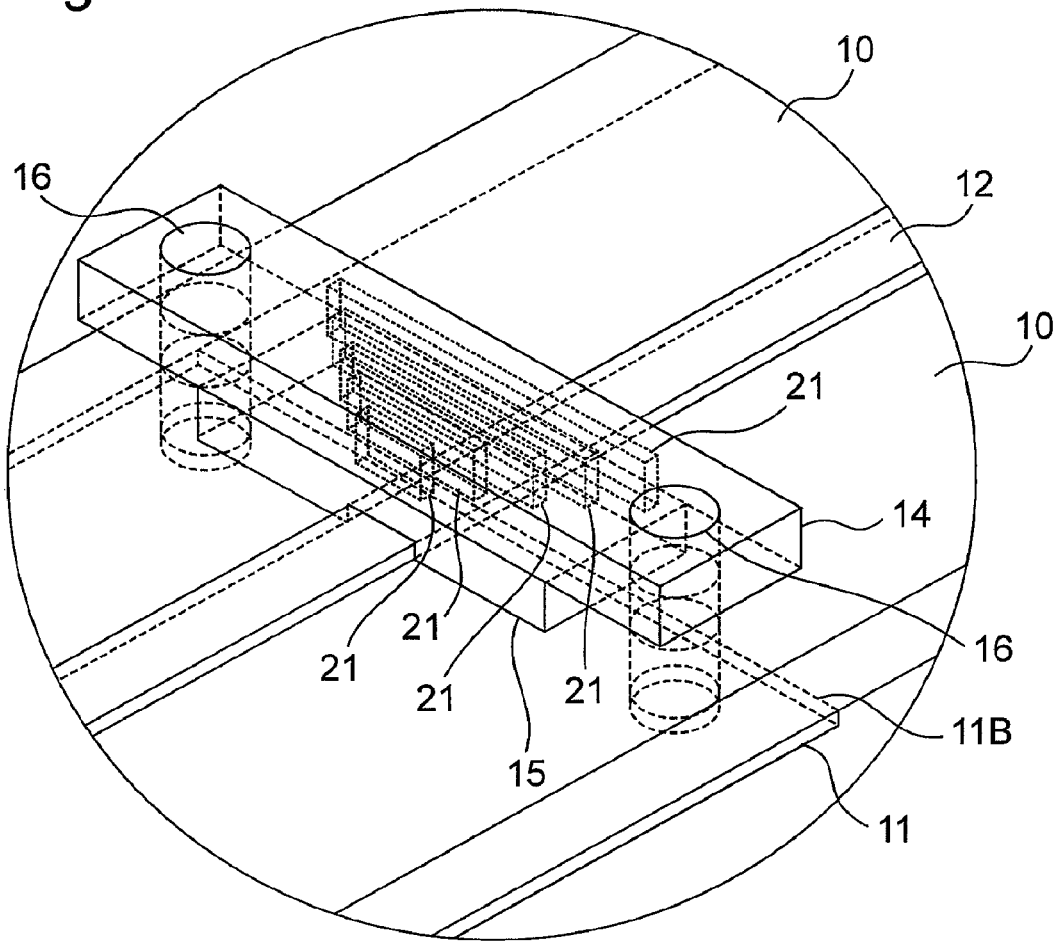
FIG. 22B is an enlarged view of principal parts shown in FIG. 22A.

FIG. 21A is a front view showing a configuration of a microstrip line according to another modified embodiment of the third embodiment of the present invention. FIG. 21B is a longitudinal sectional view taken along a line M-M' shown in FIG. 21A. FIG. 21C is an enlarged view of principal parts shown in FIG. 21B. FIG. 22A is a perspective view of the microstrip line shown in FIGS. 21A to 21C. FIG. 22B is an enlarged view of principal parts shown in FIG. 22A.

Referring to FIGS. 21A to 21C and FIGS. 22A and 22B, the microstrip line according to another modified embodiment of the third embodiment is characterized in that via conductors 16 (FIGS. 21A, 22A, and 22B) for causing the conductor section 14 having the groove structure to be conductive to the grounding conductor 11 (FIGS. 21B, 21C, 22A, and 22B) via the dielectric substrate 10 are formed on both sides across the strip conductor 12, respectively, on the microstrip line according to the third embodiment shown in FIGS. 17A to 17D. The microstrip line configured as stated above exhibits such an action and advantageous effect as changing the inductors L2 in the equivalent circuit shown in FIG. 3 by flowing of an induced current, which flows in the grounding conductor 11, in the conductor section 14 having the groove structure. In the third embodiment and the modified embodiments of the third embodiment, in a manner similar to that of the first embodiment, each of a plurality of groove 21 may be formed by either filling up the dielectric substance 22 (FIGS. 21B and 21C) made of the same material as that of the dielectric substrate 10 or made of a different material from that of the dielectric substrate 10 or may be a cavity.

Each of all the above-stated embodiments is an embodiment showing a single-ended microstrip line. However, the present invention is not limited to this. Alternatively, as shown below, a differential microstrip line may be formed. While three differential microstrip lines are exemplarily shown to correspond to three embodiments or modified embodiments, respectively, a differential microstrip line corresponding to another embodiment or modified embodiment may be formed.

Fourth Embodiment

Figure 23A:
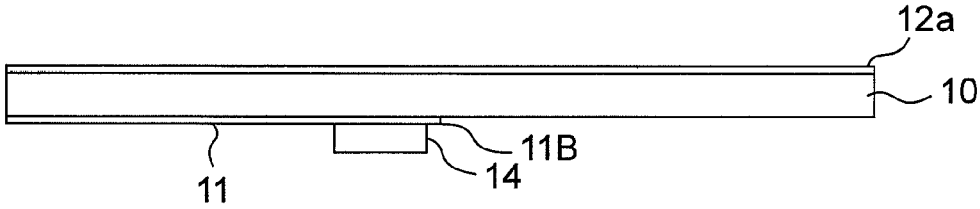
FIG. 23A is a front view of a microstrip line according to a fourth embodiment of the present invention.
Figure 23B:
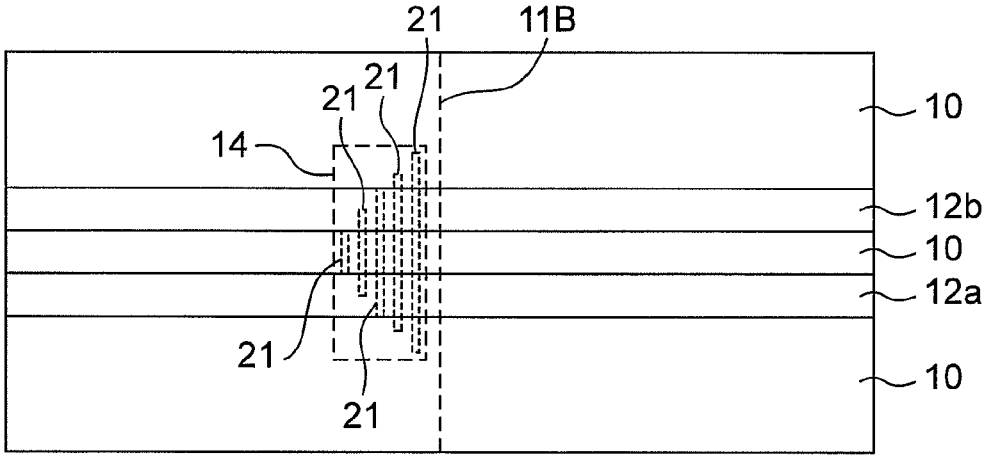
FIG. 23B is a plan view of the microstrip line shown in FIG. 23A.
Figure 23C:
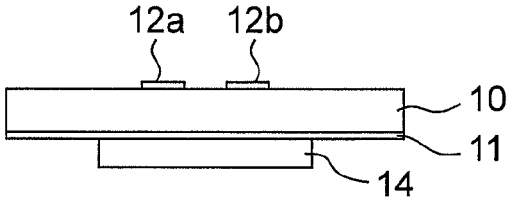
FIG. 23C is a side view of the microstrip line shown in FIG. 23A.
Figure 24:
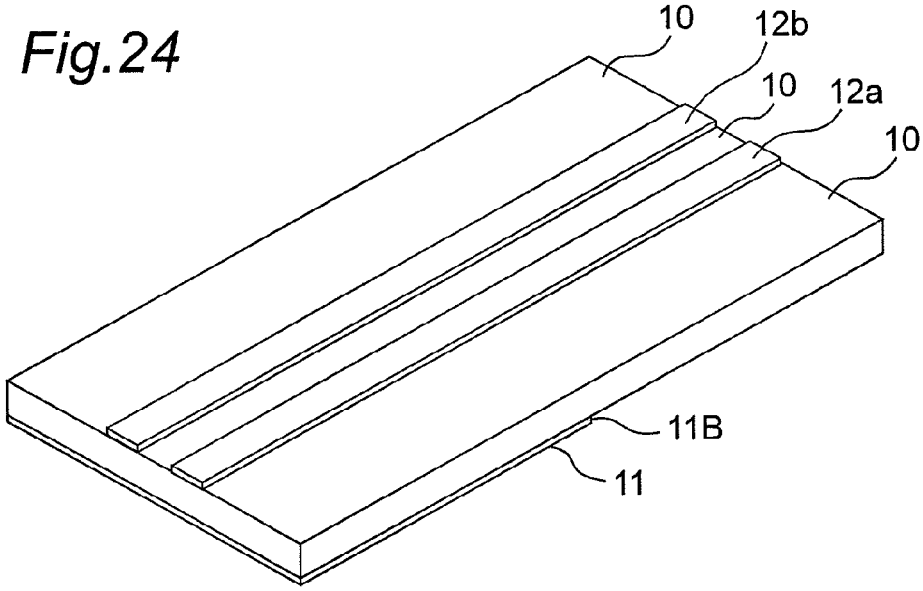
FIG. 24 is a perspective view of the microstrip line shown in FIGS. 23A to 23C.

FIG. 23A is a front view of a microstrip line according to a fourth embodiment of the present invention. FIG. 23B is a plan view of the microstrip line shown in FIG. 23A. FIG. 23C is a side view of the microstrip line shown in FIG. 23A. FIG. 24 is a perspective view of the microstrip line shown in FIGS. 23A to 23C. The microstrip line according to the fourth embodiment is characterized, as compared with the microstrip line according to the first embodiment shown in FIGS. 1 and 2, in that a differential microstrip line is formed by forming a pair of strip conductors 12*a* and 12*b* (FIGS. 23B, 23C, and 24) formed to be kept away from each other at a predetermined interval in place of the strip conductor 12. The microstrip line according to the present embodiment exhibits actions and advantageous effects similar to those of the microstrip line according to the first embodiment.

Fifth Embodiment

Figure 25A:
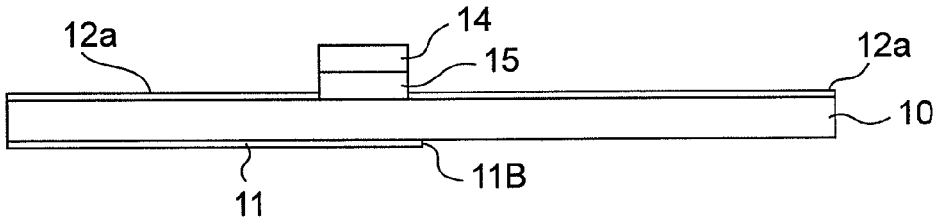
FIG. 25A is a front view of a microstrip line according to a fifth embodiment of the present invention.
Figure 25B:
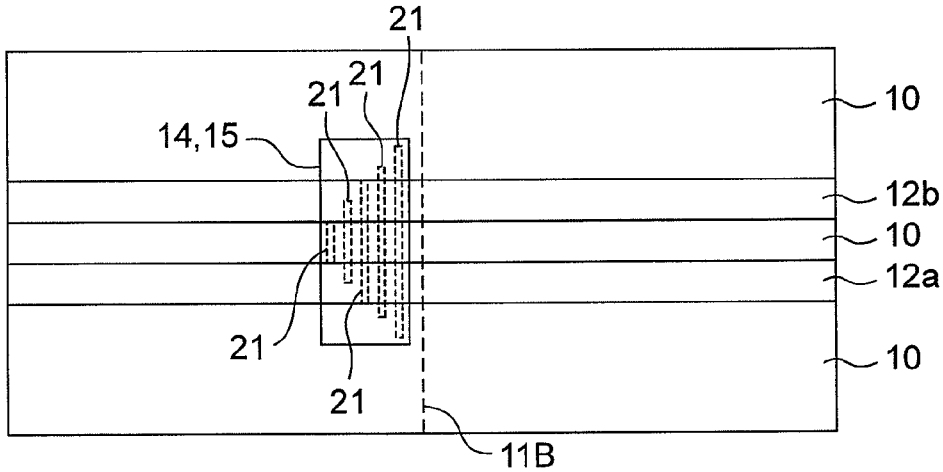
FIG. 25B is a plan view of the microstrip line shown in FIG. 25A.
Figure 25C:
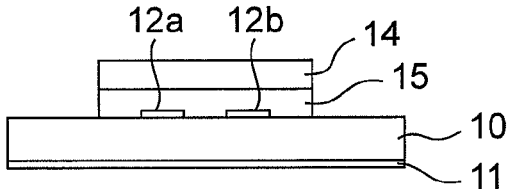
FIG. 25C is a side view of the microstrip line shown in FIG. 25A.
Figure 26:
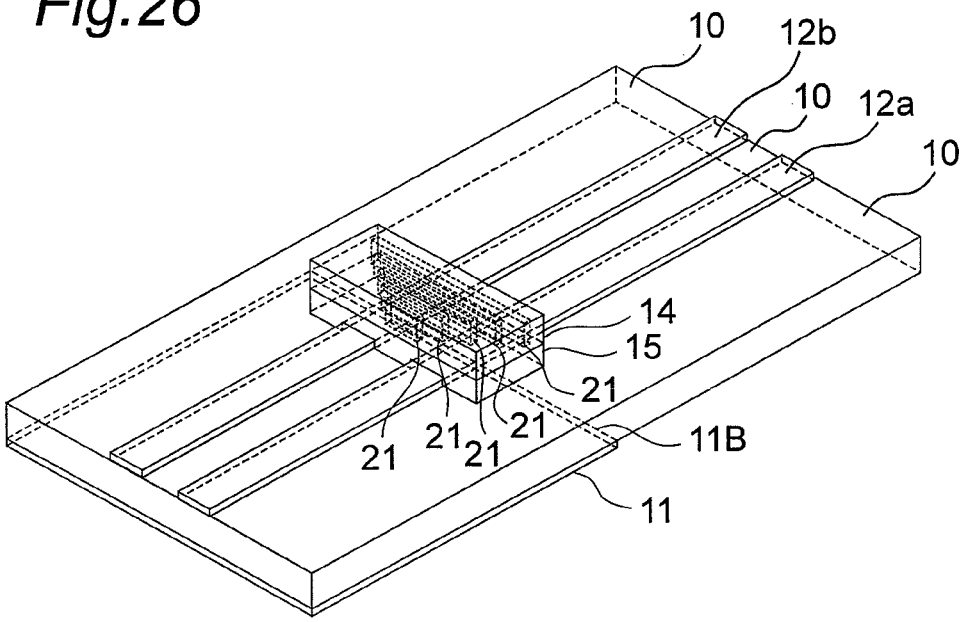
FIG. 26 is a perspective view of the microstrip line shown in FIGS. 25A to 25C.

FIG. 25A is a front view of a microstrip line according to a fifth embodiment of the present invention. FIG. 25B is a plan view of the microstrip line shown in FIG. 25A. FIG. 25C is a side view of the microstrip line shown in FIG. 25A. FIG. 26 is a perspective view of the microstrip line shown in FIGS. 25A to 25C. The microstrip line according to the fifth embodiment is characterized, as compared with the microstrip line according to the second embodiment shown in FIGS. 8A to 8C and FIG. 9, in that a differential microstrip line is formed by forming a pair of strip conductors 12*a* and 12*b* (FIGS. 25B, 25C, and 26) formed to be kept away from each other at a predetermined interval in place of the strip conductor 12. The microstrip line according to the present embodiment exhibits actions and advantageous similar to those of the microstrip line according to the second embodiment.

Sixth Embodiment

Figure 27A:
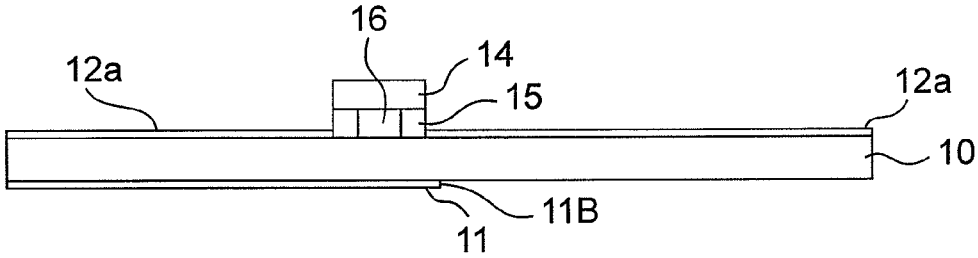
FIG. 27A is a front view of a microstrip line according to a sixth embodiment of the present invention.
Figure 27B:
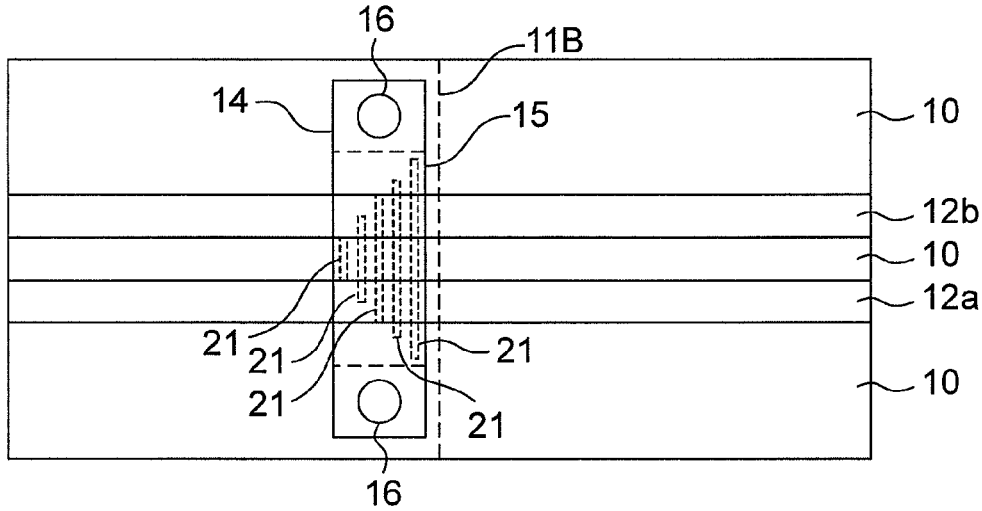
FIG. 27B is a plan view of the microstrip line shown in FIG. 27A.
Figure 27C:
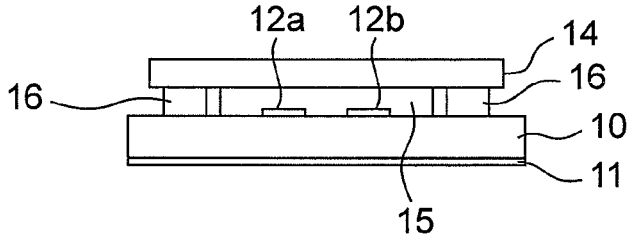
FIG. 27C is a side view of the microstrip line shown in FIG. 27A.
Figure 28:
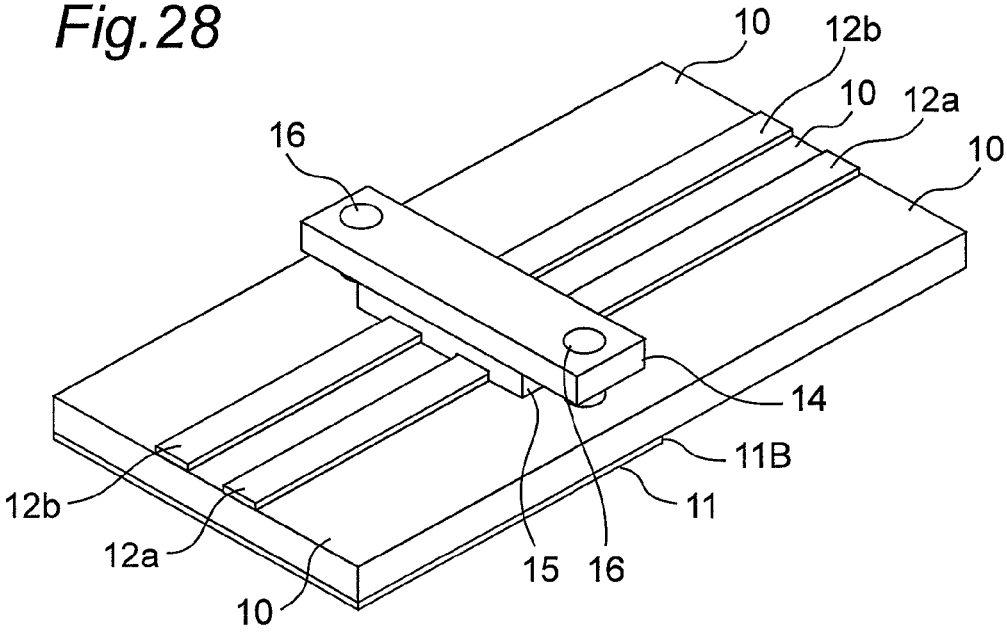
FIG. 28 is a perspective view of the microstrip line shown in FIGS. 27A to 27C.
Figure 29A:
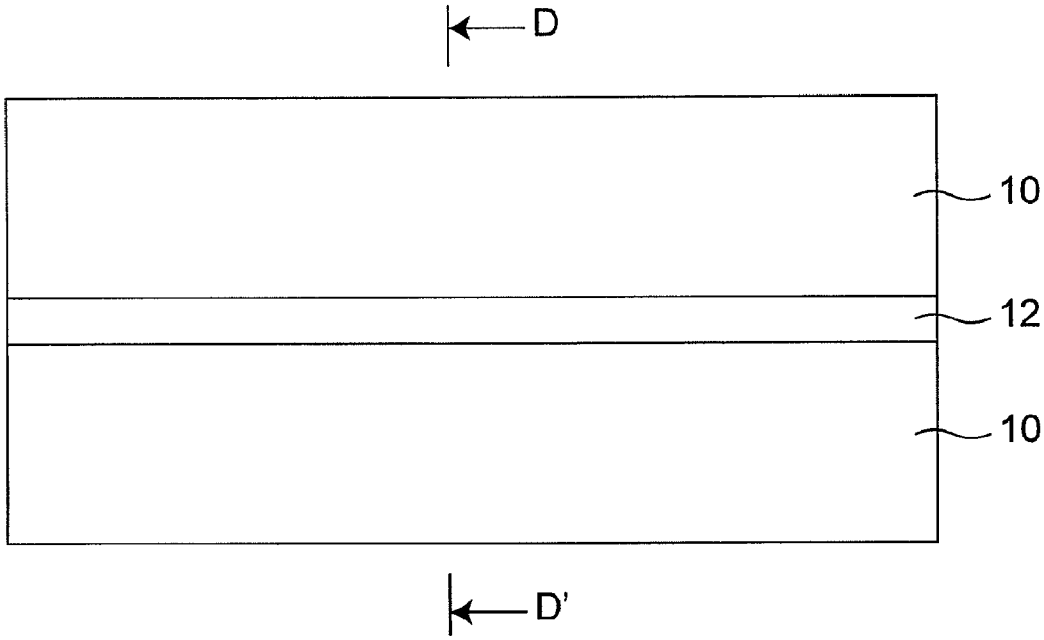
Fig.29A PRIOR ART
FIG. 29A is a plan view showing a configuration of a microstrip line according to a first prior art.
Figure 29B:
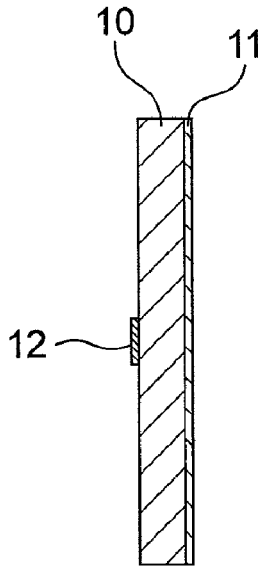
Fig.29B PRIOR ART
FIG. 29B is a longitudinal sectional view taken along a line D-D' shown in FIG. 29A.
Figure 30:
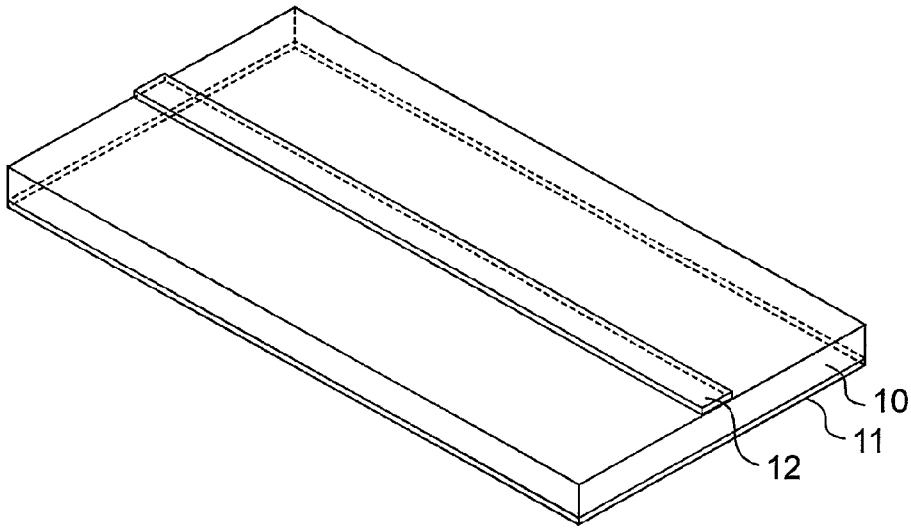
Fig.30 PRIOR ART
FIG. 30 is a perspective view of the microstrip line shown in FIGS. 29A and 29B.
Figure 31A:
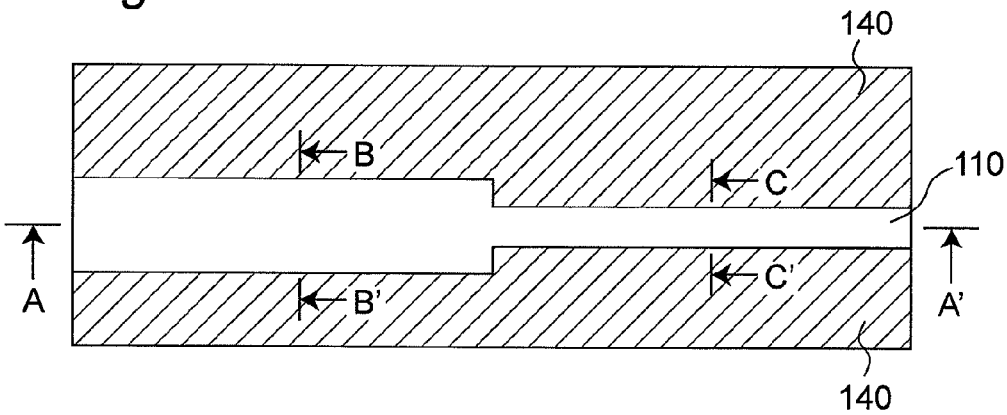
Fig.31A PRIOR ART
FIG. 31A is a plan view showing a configuration of a microstrip line according to a second prior art.
Figure 31B:
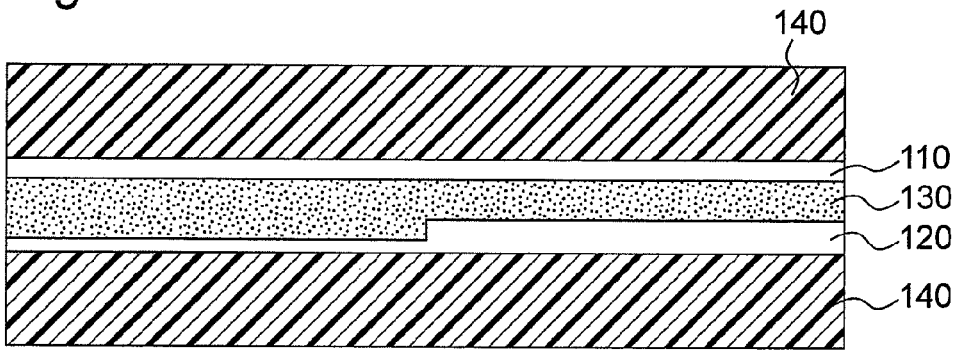
Fig.31B PRIOR ART
FIG. 31B is a longitudinal sectional view taken along a line A-A' shown in FIG. 31A.
Figure 31C:
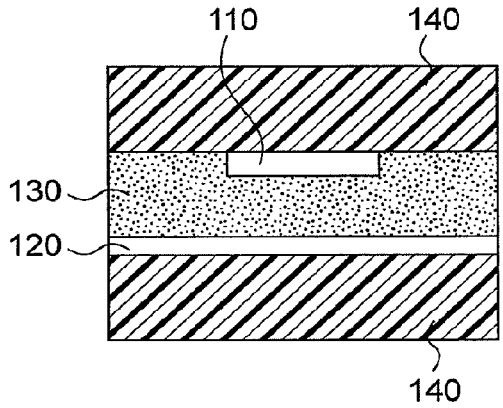
Fig.31C PRIOR ART
FIG. 31C is a longitudinal sectional view taken along a line B-B' shown in FIG. 31A.
Figure 31D:
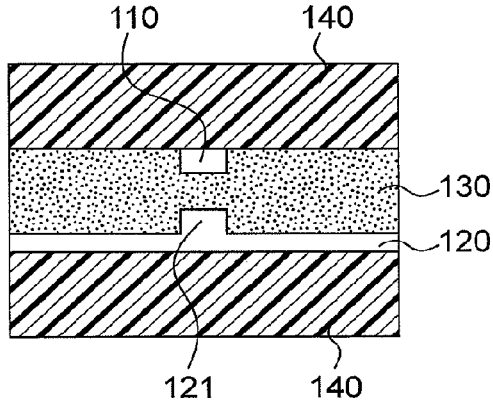
Fig.31D PRIOR ART
FIG. 31D is a longitudinal sectional view taken along a line C-C' shown in FIG. 31A.
Figure 32A:
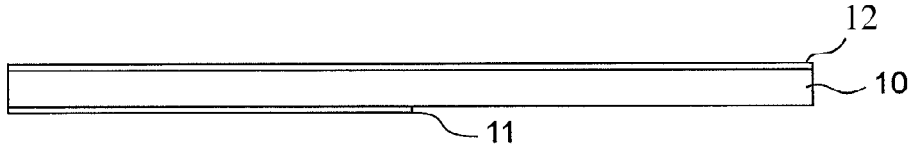
Fig.32A PRIOR ART
FIG. 32A is a front view of a microstrip line according to a third prior art.
Figure 32B:
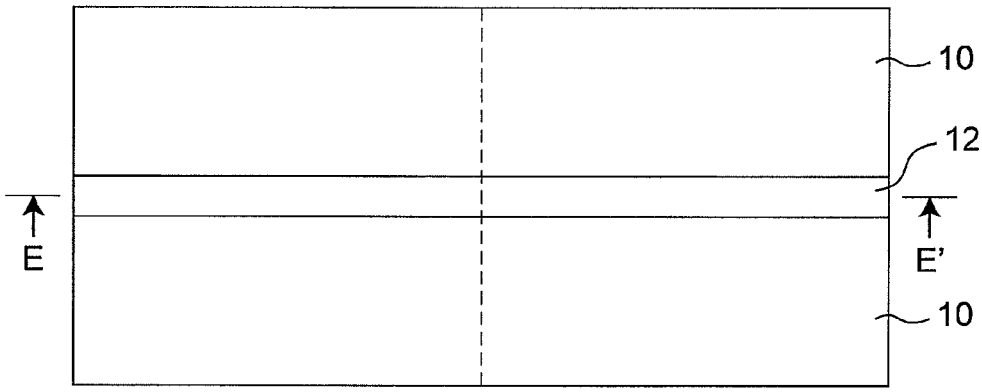
Fig.32B PRIOR ART
FIG. 32B is a plan view of the microstrip line shown in FIG. 32A.
Figure 32C:
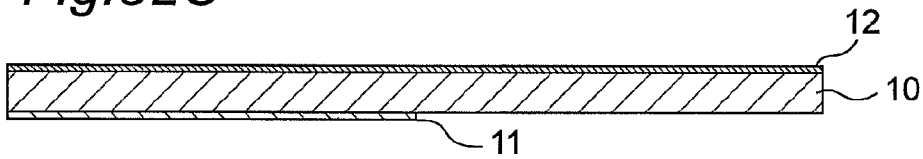
Fig.32C PRIOR ART
FIG. 32C is a longitudinal sectional view taken along a line E-E' shown in FIG. 32B.
Figure 32D:
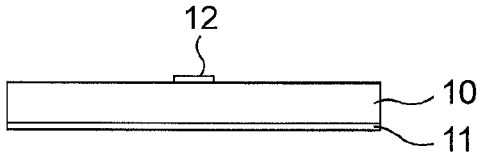
PRIOR ART Fig.32D
FIG. 32D is a side view of the microstrip line shown in FIG. 32A.
Figure 33:
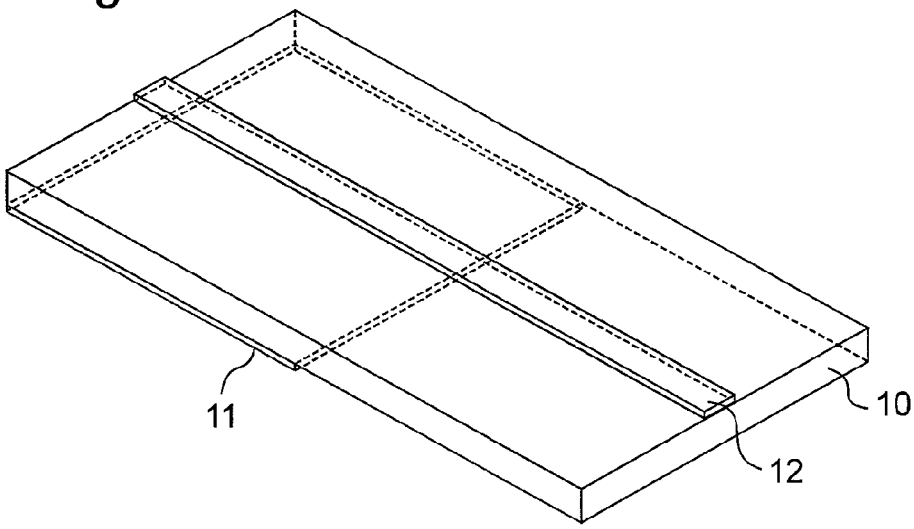
Fig.33 PRIOR ART
FIG. 33 is a perspective view of the microstrip line shown in FIGS. 32A to 32D.
Figure 34:
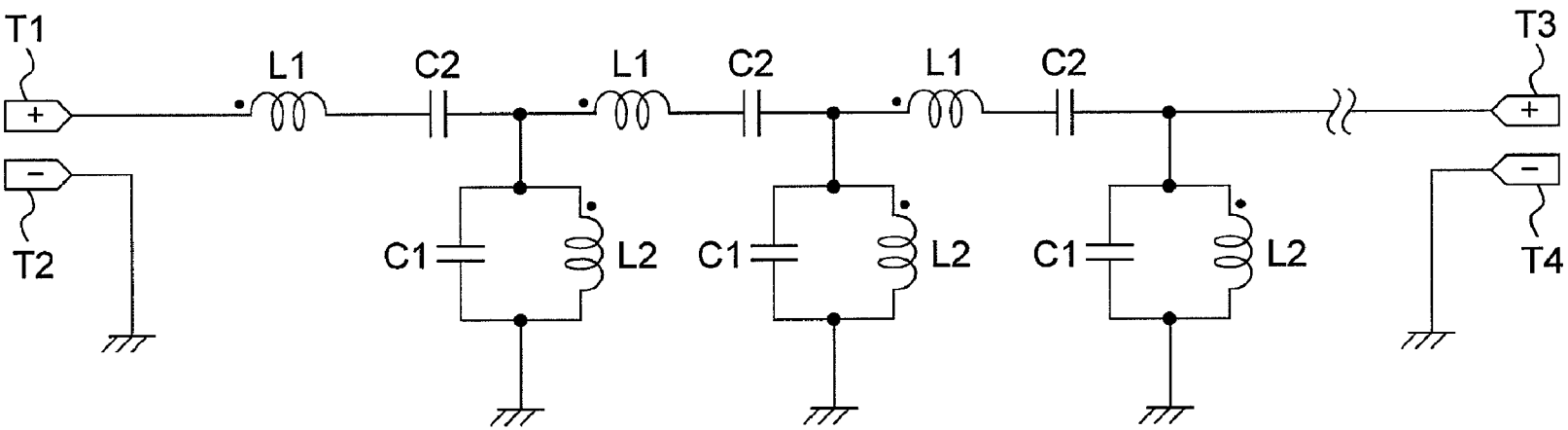
Fig.34 PRIOR ART
FIG. 34 is a circuit diagram showing an equivalent circuit to a transmission line model that illustrates a high frequency material concept that is a design theory disclosed in Non-Patent Document 1.

FIG. 27A is a front view of a microstrip line according to a sixth embodiment of the present invention. FIG. 27B is a plan view of the microstrip line shown in FIG. 27A. FIG. 27C is a side view of the microstrip line shown in FIG. 27A. FIG. 28 is a perspective view of the microstrip line shown in FIGS. 27A to 27C. The microstrip line according to the sixth embodiment is characterized, as compared with the microstrip line according to another modified embodiment of the third embodiment shown in FIGS. 21A to 21C and FIGS. 22A and 22B, in that a differential microstrip line is formed by forming a pair of strip conductors 12*a* and 12*b* (FIGS. 27B, 27C, and 28) formed to be kept away from each other at a predetermined interval in place of the strip conductor 12. The microstrip line according to the present embodiment exhibits actions and advantageous effects similar to those of the microstrip line according to the first embodiment.

INDUSTRIAL APPLICABILITY

As stated so far in detail, the microstrip line according to the present invention is the microstrip line constituted by including the grounding conductor and the strip conductor with a dielectric substrate sandwiched between the grounding conductor and the strip conductor and including a conductor section having at least one groove formed to sterically intersect the strip conductor. The microstrip line according to the present invention has thereby a substantially more uniform passing frequency characteristic as compared with the above-stated microstrip line. Therefore, even if the characteristic impedance changes, the microstrip line according to the present invention has the substantially more uniform passing frequency in the wideband. As a consequence, the microstrip line to which deterioration of a signal waveform less occurs can be realized.

In particular, if the microstrip line according to the present invention is used as a strip line or a microstrip line employed in a digital circuit, a board or the like, the microstrip line is useful as means for reducing distortions in a digital signal waveform and realizing high speed signal transmission. Moreover, since the microstrip line can attain the uniform passing frequency in the wideband, the microstrip line can be applied as means for realizing a transmission line for a high frequency circuit to which waveform distortions less occur.

The invention claimed is:

1. A microstrip line comprising:

a grounding conductor;

a strip conductor;

a dielectric substrate, the dielectric substrate being sandwiched between the grounding conductor and the strip conductor; and a conductor section connected to the grounding conductor, the conductor section having a plurality of grooves formed to three-dimensionally intersect the strip conductor, and the grooves being formed to be three-dimensionally orthogonal to the strip conductor so that respective lengths of the grooves increase in a longitudinal direction of the strip conductor, whereby the microstrip line exhibits a substantially more uniform passing characteristic as compared with a conventional microstrip line.

2. The microstrip line as claimed in claim 1, wherein the conductor section having the grooves is provided on a surface side of the dielectric substrate on which side the strip conductor is formed at a position at which the grounding conductor is formed, and wherein the microstrip line further comprises a via conductor formed in the conductor section, the via conductor connecting the conductor section having the grooves to the grounding conductor.

3. The microstrip line as claimed in claim 1, wherein the conductor section having the grooves is formed as a separate component from the microstrip line.

4. The microstrip line as claimed in claim 3, wherein a dielectric section is formed on a dielectric substrate-side of the component of the conductor section having the grooves.

5. The microstrip line as claimed in claim 3, wherein the component of the conductor section having the grooves is inserted into and arranged in an opening of the grounding conductor.

6. The microstrip line as claimed in claim 3, wherein the component of the conductor section having the grooves is inserted into and arranged in an opening of the grounding conductor and an opening of the dielectric substrate.

7. The microstrip line as claimed in claim 1, wherein the conductor section having the grooves is provided on a surface side of the dielectric substrate on which side the grounding conductor is formed at a position at which the grounding conductor is formed.

* * * * *